United States Patent [19]

Enami

[11] Patent Number: 4,563,559

[45] Date of Patent: Jan. 7, 1986

[54] INNER BOX FOR A COOKING APPLIANCE

[75] Inventor: Toshiaki Enami, Nara, Japan

[73] Assignee: Enami Seiki Mfg. Co., Ltd., Yao, Japan

[21] Appl. No.: 550,932

[22] Filed: Nov. 10, 1983

[30] Foreign Application Priority Data

| | | | |
|---|---|---|---|
| Dec. 27, 1982 | [JP] | Japan | 57-230763 |
| Dec. 27, 1982 | [JP] | Japan | 57-199331[U] |
| May 7, 1983 | [JP] | Japan | 58-68273[U] |
| May 13, 1983 | [JP] | Japan | 58-84853 |

[51] Int. Cl.[4] ..... H05B 6/64

[52] U.S. Cl. ..... 219/10.55 E; 219/10.55 D; 220/79

[58] Field of Search ..... 219/10.55 E, 10.55 D, 219/10.55 F, 10.55 B, 10.55 R; 126/273 R, 273 A, 21 A; 220/4 B, 4 R, 76, 4 D, 227, 75, 77, 78, 79; 29/512, 523

[56] References Cited

U.S. PATENT DOCUMENTS

| | | | |
|---|---|---|---|
| 3,482,727 | 12/1969 | Hitzeroth et al. | 220/4 R |
| 3,484,573 | 12/1969 | Tingley | 219/10.55 D |
| 3,702,386 | 11/1972 | Foerstner | 219/10.55 B |

OTHER PUBLICATIONS

United States Steel; "Energy Saving Solutions in Steel from U.S. Steel"; Apr. 1979, pp. 4–7.

*Primary Examiner*—C. L. Albritton
*Assistant Examiner*—M. M. Lateef
*Attorney, Agent, or Firm*—W. G. Fasse; D. H. Kane, Jr.

[57] ABSTRACT

An inner box for a cooking appliance comprises a front panel (5) having an opening, a cylindrical barrel section (6), and a rear panel (8). The peripheral edge (7A) of the opening in the front panel (5) is joined to the front end edge of the barrel (6), while the rear end edge of the barrel is joined to the outer peripheral end edge of the rear panel (8). Each of the joints is formed by a crimping operation and at least one of the crimped joints is provided with interlocking elements which engage each other as a result of the crimping operation.

6 Claims, 48 Drawing Figures

INNER BOX FOR A COOKING APPLIANCE

BACKGROUND OF THE INVENTION

1. Field of the Invention

This invention relates to an inner box for a cooking appliance and particularly it relates to the construction of an inner box for a cooking appliance, such as a microwave oven with improved seam joints.

2. Description of the Prior Art

Cooking appliances, such as microwave ovens, have been widely used, whether for business use or for household use, because of their various advantages including the ability to shorten the cooking time and to provide a constant heating. FIG. 1 is a perspective view schematically showing the typical construction of a conventional microwave oven. The microwave oven 1 has a body 2 and a door 3. The body 2 includes an inner box 4. In cooking appliances such as a microwave oven, such an inner box 4 is provided for an effective use of heat and for preventing the leakage of electric waves; thus, the body 2 has a doubled wall construction.

FIG. 2 is a perspective view schematically showing a conventional inner box. The inner box 4 comprises a front panel 5, a barrel section 6, and rear plates (not shown). The barrel section 6 is of cylindrical construction, including a top panel 9 and a barrel panel 10 of U-shaped cross section. The front panel 5 surrounds an opening 7 into the barrel section 6 to enable the putting in and taking out of food to be cooked. The barrel section 6 and front panel 5 are joined together at the peripheral edges of the panels 10 and 9 and at the peripheral edge 7A of the opening 7. Though not shown, the barrel section 6 and rear panel are joined together at the rear end edges 10B and 9B of the barrel and top panels 10 and 9 and the outer peripheral end edge of the rear panel. Therefore, the inner box 4 is in the form of a hexahedron, with the opening 7 located only in the front of the box.

In the front box 4 of the conventional microwave oven 1 constructed in the manner described above, the front panel 5, barrel panel 10, top panel 9 and rear panel are joined together by spot welding for lightly closing the inner box 4, to prevent the leakage of electric waves and to strengthen the structure. Spot welding, however, has the disadvantages of requiring much time and labor in forming the joints. Further, automating a spot welding operation is not easy, and hence it is impossible to increase the efficiency of the joining operation.

Further, the inner box 4, as an article of commerce, must have its outer visible portions painted for an acceptable appearance. If, therefore, the inner box 4 is constructed of a painted steel a separate painting operation may be omitted. Where spot welding is to be used, however, the portions to be joined, which are insulated by the paint, must have their paint removed and then repainted after the spot welding is completed. Thus, since the repainting operation cannot be avoided where spot welding is used, the merit of using painted steel sheets in the first place is lost. Therefore the case of the inner box 4 of the prior art, unpainted steel sheets are used and joined together, followed by a painting operation. Hence, in addition to the troublesome spot welding, it has been inevitable to perform a painting operation which is also troublesome and hence much time and labor have been consumed for producing the inner box 4.

SUMMARY OF THE INVENTION

Accordingly, a principal object of this invention is to provide an inexpensive inner box for cooking appliances, eliminating the aforesaid drawbacks, wherein the joint strength is high and the joining of the box walls to each other can be efficiently performed.

In brief, this invention is an inner box for cooking appliances comprising a front panel having an opening, a cylindrical barrel section, and a rear panel, wherein the peripheral edge of the opening in said front panel is joined to the front end edge of the barrel section and the rear end edge of the barrel section is joined to the outer peripheral end edge of the rear panel, said inner box being characterized in that each joint is formed by curling or rather crimping.

The aforesaid object and other objects and features of this invention will become more apparent from the following detailed description to be given with reference to the drawings.

DESCRIPTION OF THE PREFERRED EMBODIMENTS AND OF THE BEST MODE OF THE INVENTION

Figure 1:
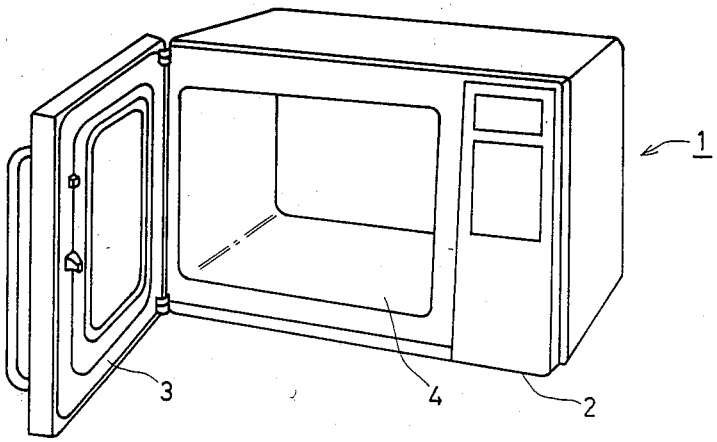
FIG.1 PRIOR ART
FIG. 1 is a perspective view showing a microwave oven as an example of a cooking appliance.
Figure 2:
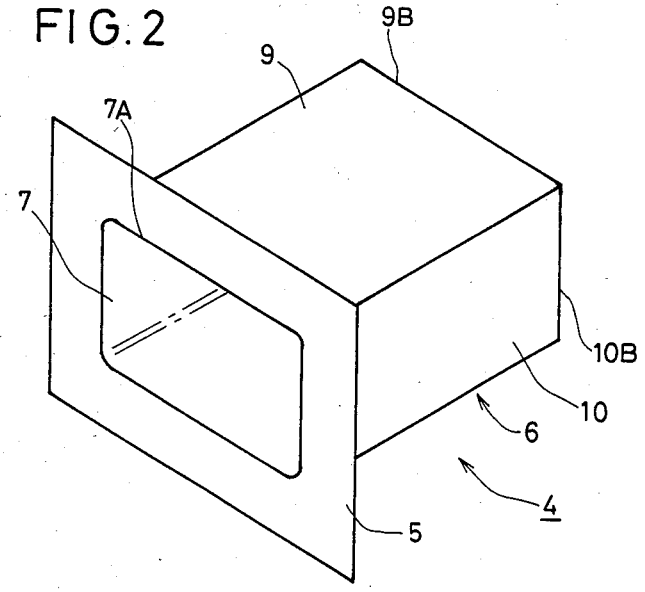
PRIOR ART FIG.2
FIG. 2 is a perspective view showing the general configuration of the inner box of a cooking appliance.
Figure 3:
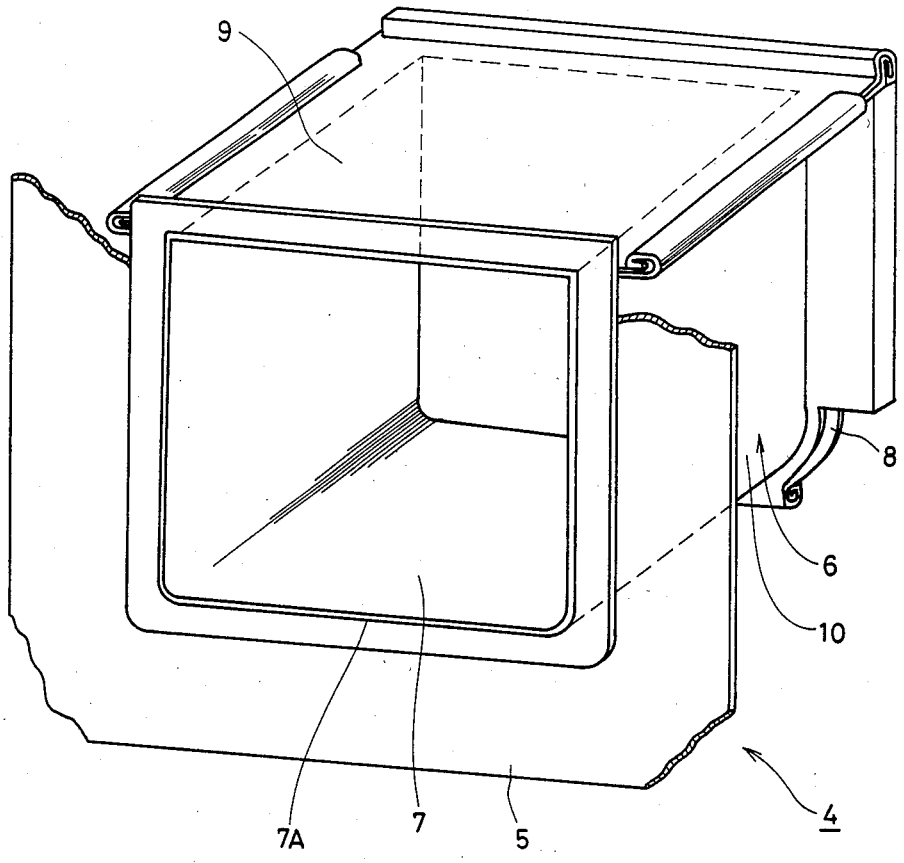
FIG. 3 is a perspective view, partly broken away, of an inner box for cooking appliances according to an embodiment of this invention.

FIG. 3 is a perspective view, partly broken away, showing an inner box for a microwave oven according to an embodiment of this invention. The inner box 4 comprises a front panel 5, a barrel section 6, and a rear panel 8. The front panel 5 has an opening 7. The barrel section 6 comprises a top panel 9 and a barrel panel 10 of U-shaped cross-section. Therefore, the overall configuration does not differ from that of the inner box 4 of the conventional microwave oven shown in FIG. 2.

The feature of the inner box 4 of this embodiment lies in the fact that each joint is formed by curling or crimping. That is, the joints between the front panel 5 and the top panel 9, between the front panel 5 and the barrel panel 10, between the barrel panel 10 and the rear panel 8, and between the top panel 9 and the rear panel 8 are all made by curling or crimping. In addition, it is to be pointed out that the joints between the barrel panel 10 and the top panel 9, between the barrel panel 10 and the rear panel 8, and between the top and panel 9 and the rear panel 8 can all be formed by the apparatuses and methods described in Japanese Patent Publication numbers 54230/1980, 54231/1980, and 54221/1980 filed with the Japanese Patent Office by the same applicant. Further, the joints between the front panel 5 and the top panel 9 and between the front panel 5 and the barrel panel 10 are formed by an entirely new type of curling or crimping operation to be described below, and the entire inner box 4 is constructed by this curling or crimping operation according to the invention.

FIGS. 4 to 9 are diagrammatic views for explaining a joining operation or joining construction applied to the inner box 4 of the embodiment shown in FIG. 3.

Figure 4:
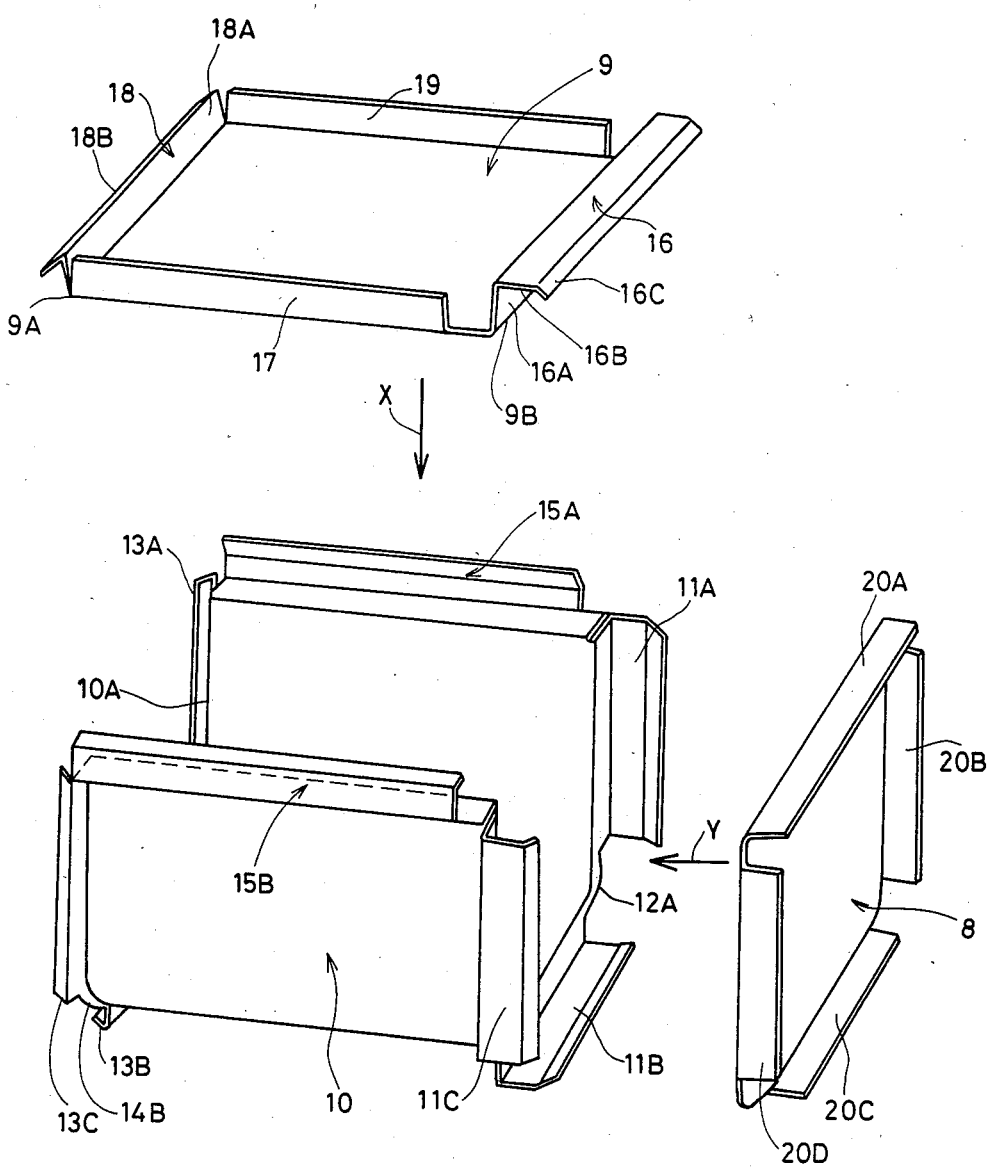
FIG. 4 is a perspective view showing a joining operation on the embodiment shown in FIG. 3.

FIG. 4 is a perspective view showing the first step of operation for joining the inner box 4 of this embodiment. The barrel panel 10 is made of a sheet of metal, e.g., stainless steel and has three curling allowances 11A, 11B and 11C and flange portions 12A on one longitudinal side of the sheet. Only the flange portion 12A at the far right corner is visible. The barrel panel 10 further comprises three curling or crimping allowances 13A, 13B and 13C and flange portions 14B on another longitudinal side. Only the flange portion 14B at the left near corner is visible. The barrel panel 10 further comprises curling or crimping allowances 15A and 15B respectively on the other two sides, and then the sheet is bent so as to form a U-shape. The top panel 9 is formed with curling or crimping allowances 16, 17, 18 and 19 respectively on its outer peripheral edges. The rear panel 8 is formed with curling or crimping allowances 20A, 20B, 20C and 20D respectively on its outer peripheral edges.

The top, barrel and rear panels 9, 10 and 8 thus formed with curling or crimping allowances are joined together in the following manner. Incidentally, curling and crimping are used as synonyms herein. First, the top panel 9 is combined with the barrel panel 10 in the direction of arrow X in FIG. 4. Then, the curling allowance 17 of the top panel is joined to the curling allowance 15B of the barrel panel 10 and the curling allowance 19 of the top panel 9 is joined to the curling allowance 15A of the barrel panel 10 by curling. After the top panel 9 has been joined to the barrel panel 10 by curling, the rear panel 8 is combined with the barrel panel 10 in the direction of arrow Y in FIG. 4. Subsequently, the curling allowance 11A of the barrel panel 10 is joined to the curling allowance 20B of the rear panel 8, the curling allowance 11B of the barrel panel 10 to the curling allowance 20C of the rear panel 8, the curling allowance 11C of the barrel panel 10 to the curling allowance 20D of the rear panel 8, and the curling allowance 16 of the top panel 9 to the curling allowance 20A of the rear panel 8, respectively by curling. Thus, the top, barrel and rear panels 9, 10 and 8 are firmly joined together by curling at six places.

The joints provided by these curling operations at six places are all the same in construction and differ only in positional relation. Therefore, only the joint between the top panel 9 and the rear panel 8 will be described by way of an example. The curling allowance 16 of the top panel 9 comprises a first wing portion 16A extending from the rear end edge 9B of the top panel 9 and bent at right angles to the top panel 9, a second wing portion 16B bent at right angles to the first wing portion 16A and extending from the front end of the latter in a direction parallel to the main surface of the top panel 9, and a third wing portion 16C obliquely downwardly bent at the front end of the second wing portion 16B. The curling allowance 20A of the rear panel 20 adapted to cooperate with the curling allowance 16 of the top panel 9 to form a curled portion, comprises a wing portion extending rearwardly above the rear panel so that it is parallel to the main surface of the rear panel 8. When the rear panel 8 is abutted against the barrel and top panels 10 and 9, the second wing portion 16B of the curling allowance 16 is positioned to lie on the curling allowance 20A. Then, a support member is abutted against the front surface of the first wing portion 16A of the curling allowance 16, i.e., the surface opposite to the second wing portion 16B, while a curling die is pressed against the rear panel 8 rearwardly of the latter, for performing a curling operation. The result of this curling operation is shown in FIG. 3.

Figure 5:
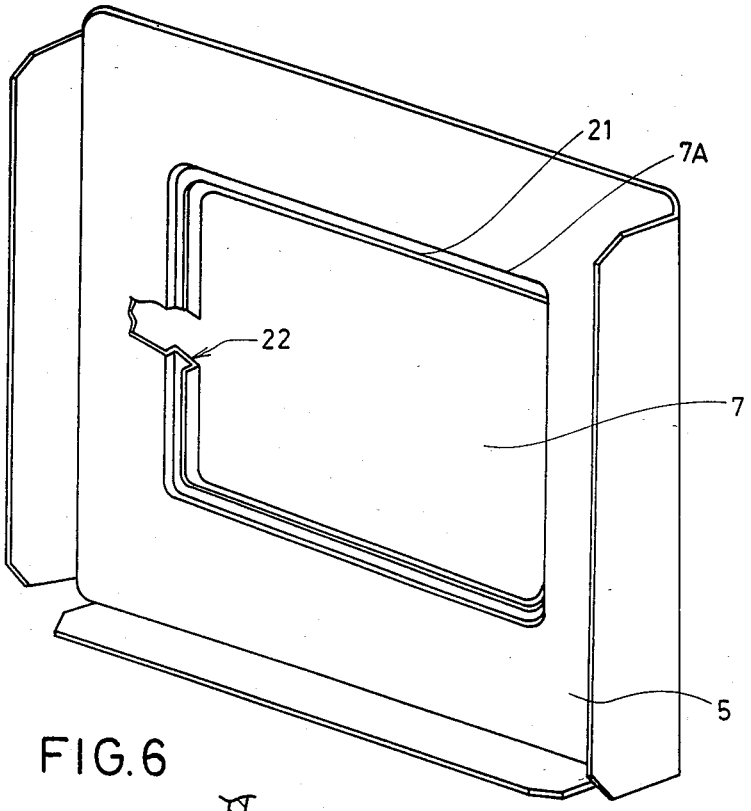
FIG. 5 is a perspective view looking at the back of the front panel of the embodiment shown in FIG. 3.
Figure 6:
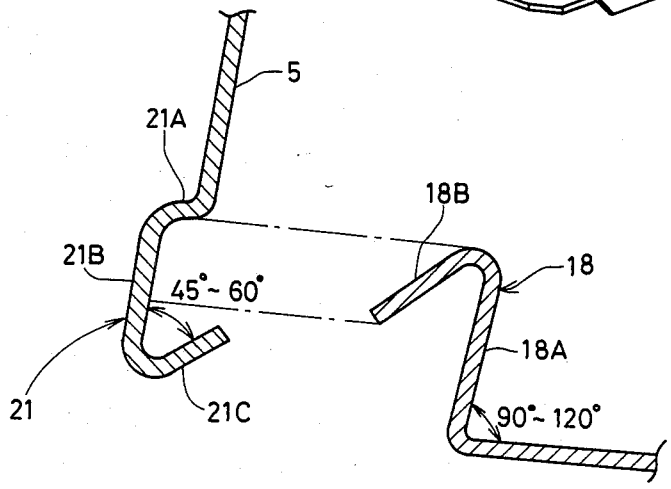
FIG. 6 is a fragmentary sectional view for explaining the formation of the joint between the front and top panels in the embodiment shown in FIG. 3.

FIGS. 5 and 6 are views for explaining the joining of the front, barrel and top panels 5, 10 and 9.

As shown in FIG. 5, the front panel 5 is provided with an opening 7. The peripheral edge 7A of the opening 7 is formed with a curling allowance 21 throughout the periphery for joining to the barrel panel 10 and to top panel 9. The configuration of this curling allowance 21 is shown by an end surface 22 shown in a broken away fashion. That is, as shown in FIG. 6, the curling allowance 21 comprises a first wing portion 21A extending forwardly of the front panel 5, a second wing portion 21B extending from the front end of the first wing portion 21A and bent toward the opening, and a third wing portion 21C extending from the second wing portion 21B and bent backward. The angles between the front panel 5 and the first wing portion 21A and between the first and second wing portions 21A and 21B are each about 90°. Further, the angle between the second and third wing portions 21B and 21C is selected to be about 45° to 60°.

On the other hand, the front end edge 9A of the top panel 9 to be joined to the peripheral edge 7A of the opening 7 in the front panel 5 is formed with a curling allowance 18, as shown in FIG. 4. As is clear from FIG. 6, the curling allowance 18 comprises a first wing portion 18A extending from the top panel 9 upwardly at an angle of about 45° to 120°, and a second wing portion 18B extending from the front end of the first wing portion 18A and bent to form an angle of about 45° to 60°.

Further, the front end edge 10A of the barrel panel 10 to be joined to the opening 7 in the front panel 5 is formed at its linear portions with curling allowances 13A, 13B and 13C, and at its corners with flange portions 14B, as is clear from FIG. 4. The curling allowances 13A, 13B and 13C are the same in shape as the curling allowance 18 formed on the top panel.

As is clear from FIG. 6, the joint between the curling allowance 21 of the opening 7 and the curling allowance 18 of the top panel 9 is so selected that the front end of the second wing portion 18B of the curling allowance 18 comes inside the third wing portion 21C of the curling allowance 21. Therefore, this joining is achieved by pressing against the outer or front surface of the second wing portion 21B of the curling allowance 21 after abutting the front panel 5 against the top panel 9. This explanation also applies to the joint between the front panel 5 and the barrel panel 10. The reason why such particular type of curling operation is performed in joining the front panel 5 to the top panel 9 and to the barrel panel 10 is that the so-called ordinary curling cannot be effected because the joining of the front panel 5 is performed after to the joining of the barrel panel 10 and the top panel 9.

Figure 7:
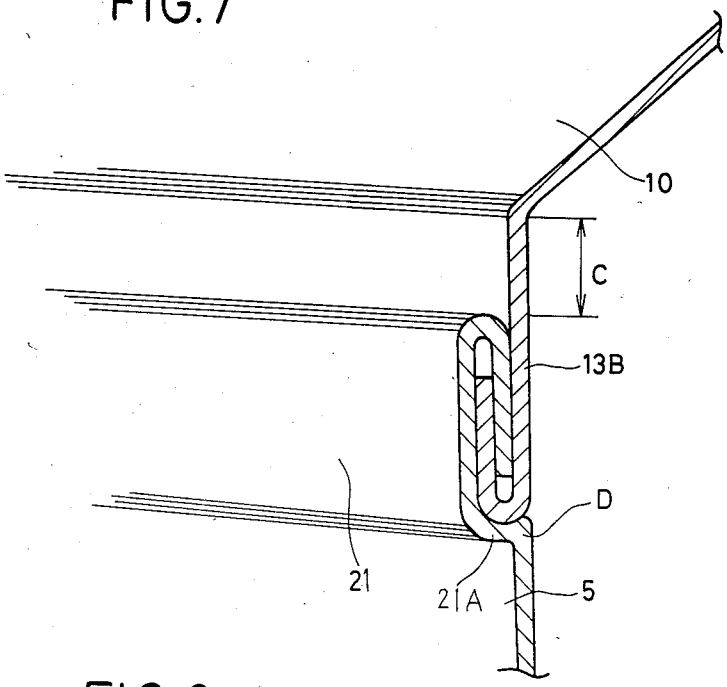
FIG. 7 is a fragmentary perspective view showing the construction of a joint between the front and barrel panels in the embodiment shown in FIG. 3.
Figure 8:
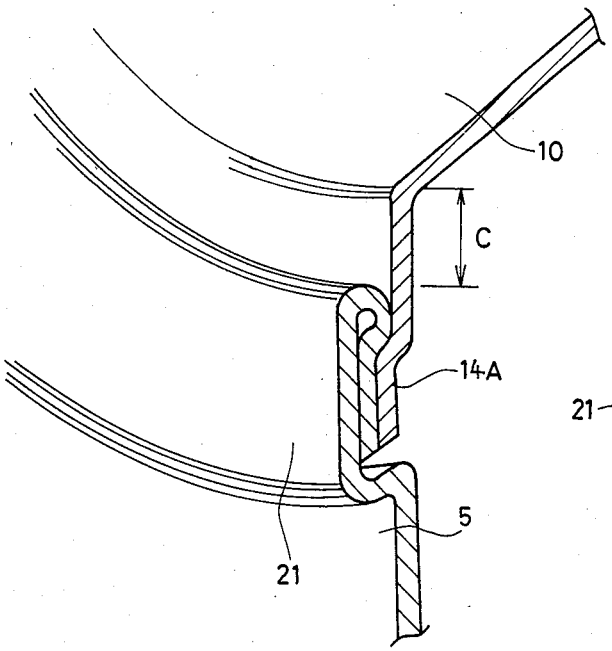
FIG. 8 is a fragmentary perspective view showing the construction of a joint between the front and barrel panels at a corner of the peripheral edge of an opening in the front panel in the embodiment shown in FIG. 3.

The construction of the joint of the opening 7 to the top and barrel panels 9 and 10 is not the same throughout the peripheral edge 7A of the opening 7. That is, in the linear portions of the peripheral edge 7A of the opening 7, the aforesaid curling is effected, whereas at the corners of the peripheral edge 7A, as is clear from FIG. 8, the curling allowance 21 of the opening 7 in the front panel 5 is pressed against the flange portion 14A of the barrel panel 10. As shown in FIG. 7, in the linear portions where curling has been effected, the front and barrel panels 5 and 10 are firmly fixed together. Particularly, in this type of curling operation, since the curling allowance 21 of the front panel 5 has the first wing portion 21A, a curved portion D is formed after joining. For this reason, even if a force is applied vertically in FIG. 7, there is no danger of the front and barrel panels 5 and 10 being separated, since they are firmly fixed together. The presence of the curved portion D greatly increases the degree of pressing action on the joint. This is because the front and barrel panels 5 and 10, which are made of metal, have the ability to restore their original form after being curled due to the so-called spring-back. Thus, since the metal pressed in the joint tends to return, the joint might become loosened. However, because of the presence of the curved portion D in the curled joint, the portion D and the curling allowance 13B of the barrel panel 10 are strongly pressed against each other by the action of spring-back, so that the closed state of the joint is assured. For this reason, prevention of leakage of electric waves, which is particularly important in microwave ovens, can be thoroughly attained.

Figure 9:
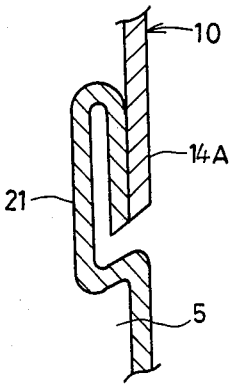
FIG. 9 is a fragmentary sectional view showing another example of the construction of a joint in the zone shown in FIG. 8.

On the other hand, in the corner portions of the peripheral edge 7A of the opening 7, the flange portions 14A and 14B of the barrel panel 10 are pressed against the curling allowance 21. Thus, as is clear from FIG. 8, though not curled, the front end of the curling allowance 21 and the flange portion 14A are strongly pressed against each other by the action of spring-back. Therefore, the joint between the front and barrel panels 5 and 10 is in a closely contacted state even in the corner portions of the peripheral edge 7A of the opening 7. In addition, it is to be pointed out that the joining in the corner portions can be attained even if there is no flange portion projecting toward the barrel panel 10, as shown in FIG. 9 That is, the curling allowance 21 of the front panel 5 and the planar flange portion 14A of the barrel panel 10 are pressed against each other and thereby joined together. In this case also, strong pressing is attained by the action of spring-back of the curling allowance 21.

As described above, the joining of the front and barrel panels 5 and 10 is attained by the novel curling operation which provides ruggedness and a high sealing effectiveness to the joint. It is to be pointed out that the joint between the front and top panels 5 and 9 can be formed by the same curling operation.

Figure 10:
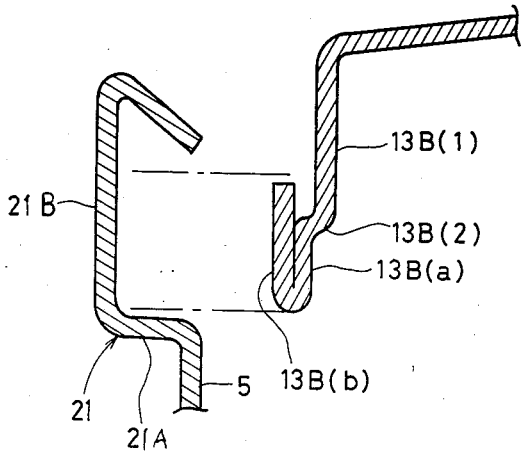
FIG. 10 is a fragmentary sectional view showing another example of a crimping allowance for the barrel panel in the embodiment shown in FIG. 3.
Figure 11:
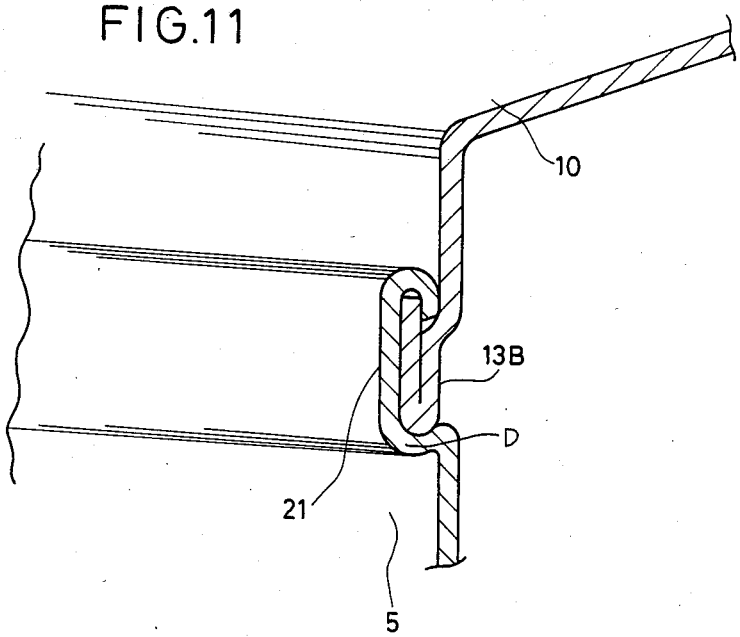
FIG. 11 is a fragmentary sectional view showing the construction of a joint between the front panel and the barrel panel using the crimping allowance shown in FIG. 10.

FIGS. 10 and 11 are fragmentary sectional views showing another crimping example between the front and barrel panels 5 and 10. FIG. 10 is similar to FIG. 6 and FIG. 11 is similar to FIG. 7. As is clear from FIG. 10, the curling allowance 21 of the front panel 5 is the same as that shown in FIG. 6. The feature of this example resides in the curling allowance 13B of the barrel panel 10, comprising a first bent portion 13B(1) bent outwardly from the barrel panel 10 at an angle of about 90° to 120°, a second bent portion 13B(2) bent forwardly of the front end of the first bent portion 13B(1), a first wing portion **13B(*a*) extending from the second bent portion 13B(2) downwardly at an angle of about 90° to 120°, and a second bent portion 13B(*b*) turned back from the lower end of the first bent wing portion 13B(*a*). The length of the second wing portion 13B(*b*) is so selected that it can be fitted into the curling allowance 21 of the front panel 5. As is clear from FIG. 11, the curling allowance 13B in this example has substantially the same function as the curling allowance 13B shown in FIG. 7. That is, since the curling allowance 21** is the same, an arcuate or curved portion D is formed after joining, thus ensuring firm fixing.

In the embodiments described above, in describing the configuration of each curling allowance, the angle has been specified, but there is no need to limit such angle to the specified values in achieving the objects of the invention. That is, so long as the curling operation is possible, curling allowances with suitable angles may be selected.

Figure 12:
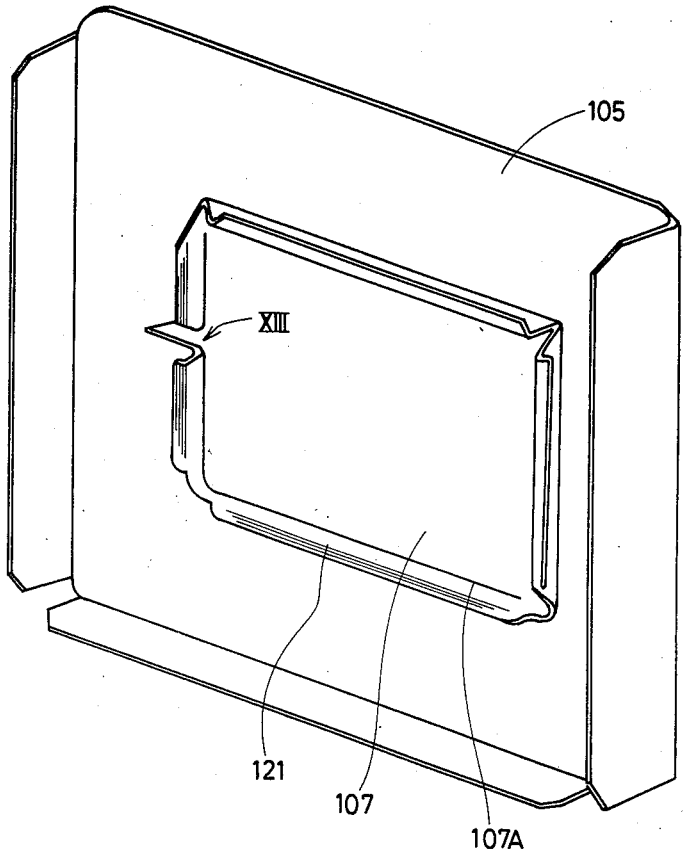
FIG. 12 is a perspective view similar to FIG. 5, looking at the back of a front panel used in a second embodiment of this invention.
Figure 13:
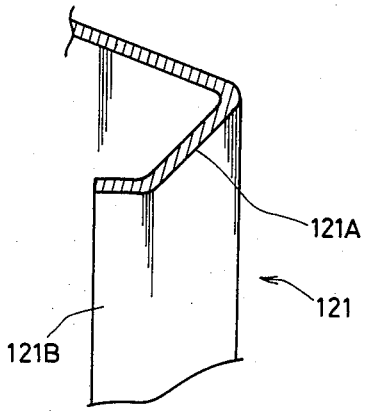
FIG. 13 is an enlarged fragmentary view of a portion XIII in FIG. 12.

FIG. 12 is a rear perspective view of a front panel 105 used in producing a second embodiment of this invention. The feature of this second embodiment resides in the construction of the joint between the front panel 105 and a barrel panel (not shown in FIG. 12), and the construction of the joint between the front panel 105 and a top panel (not shown in FIG. 12). The rest of the structure is the same as in the first embodiment shown in FIG. 3. Therefore, the constructions of the joints between the front panel 105 and barrel panel and between the front panel 105 and top panel will be described. As is clear from FIG. 12, the end edge 107A of an opening 107 in the front panel 105 is formed with a first curling allowance 121. FIG. 13 shows on an enlarged scale, a portion indicated at XIII in FIG. 12. The first curling allowance 121 comprises a first bent portion 121A extending from the main surface of the front panel 105 and bent substantially vertically toward the barrel section, and a second bent portion 121B extending from the front end of the first bent portion 121A in the direction which widens the opening. On the other hand, though not shown, as in the case of the first embodiment shown in FIG. 3, the barrel section comprises a barrel panel and a top panel, which are formed each with a second curling allowance. The joining of the front panel 105 and barrel panel is effected by joining the first curling allowance 121 of the front panel 105 to the second curling allowances of the barrel section by curling. In addition, since the construction of the joint between the front panel 105 and top panel is the same as the construction of the joint between the front panel 105 and barrel panel, the construction of the joint between the front panel 105 and top panel will be described by way of example.

Figure 14:
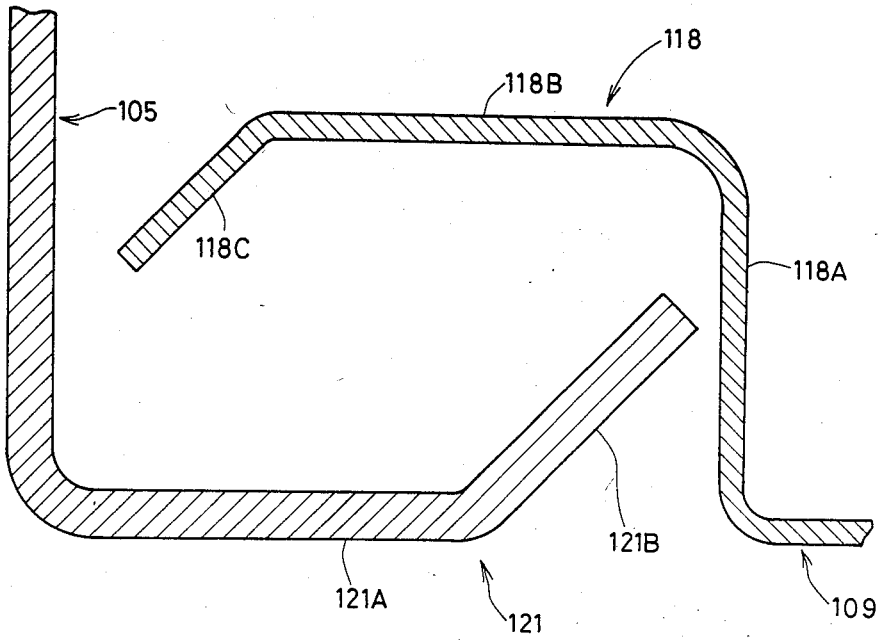
FIG. 14 is a fragmentary sectional view for explaining an operation for joining the front and barrel panels shown in FIG. 12.
Figure 15:
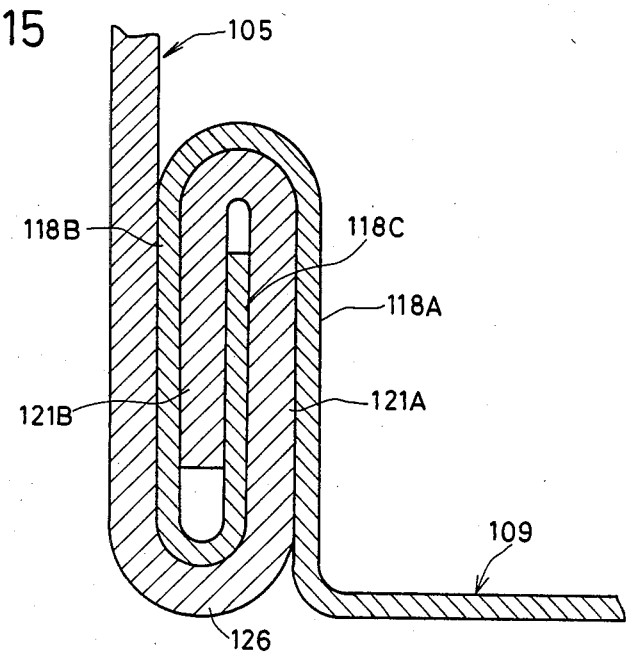
FIG. 15 is a fragmentary sectional view showing the construction of the joint between the front and barrel panels joined by the joining operation shown in FIG. 14.

FIG. 14 is a fragmentary sectional view for explaining an operation for joining the first curling allowance 121 of the front panel 105 to the second curling allowance 118 of the top panel 109. FIG. 15 is a fragmentary sectional view showing the joined state. When the front panel 105 is brought nearer to the top panel 109, the first curling allowance 121 approaches the second curling allowance 118, as shown in FIG. 14. In this condition, by applying a curling die to the periphery to move the first curling allowance 121 and/or the second curling allowance 118 in the direction which presses them against each other, a curled joint is formed, as shown in FIG. 15. As is clear from FIG. 15, the joint formed by curling between the front and top panels 105 and 109 is strong. A curved surface portion 126 (see FIG. 15) formed between the second bent portions 121A of the curling allowance 121 of the front panel 105 and the main surface of the front panel 105 has a relatively large radius of curvature because between the first bent portion 121A and the main surface of the front panel 105, there lie the fifth bent portion 118C of the top panel 109, the second bent portion 121B of the front panel 105, and the front bent portion 118B of the top panel 109. Therefore, even when the front panel 105 is formed of an inexpensive painted steel sheet, there is no danger of the paint being peeled off at the curved surface portion 126.

Figure 16:
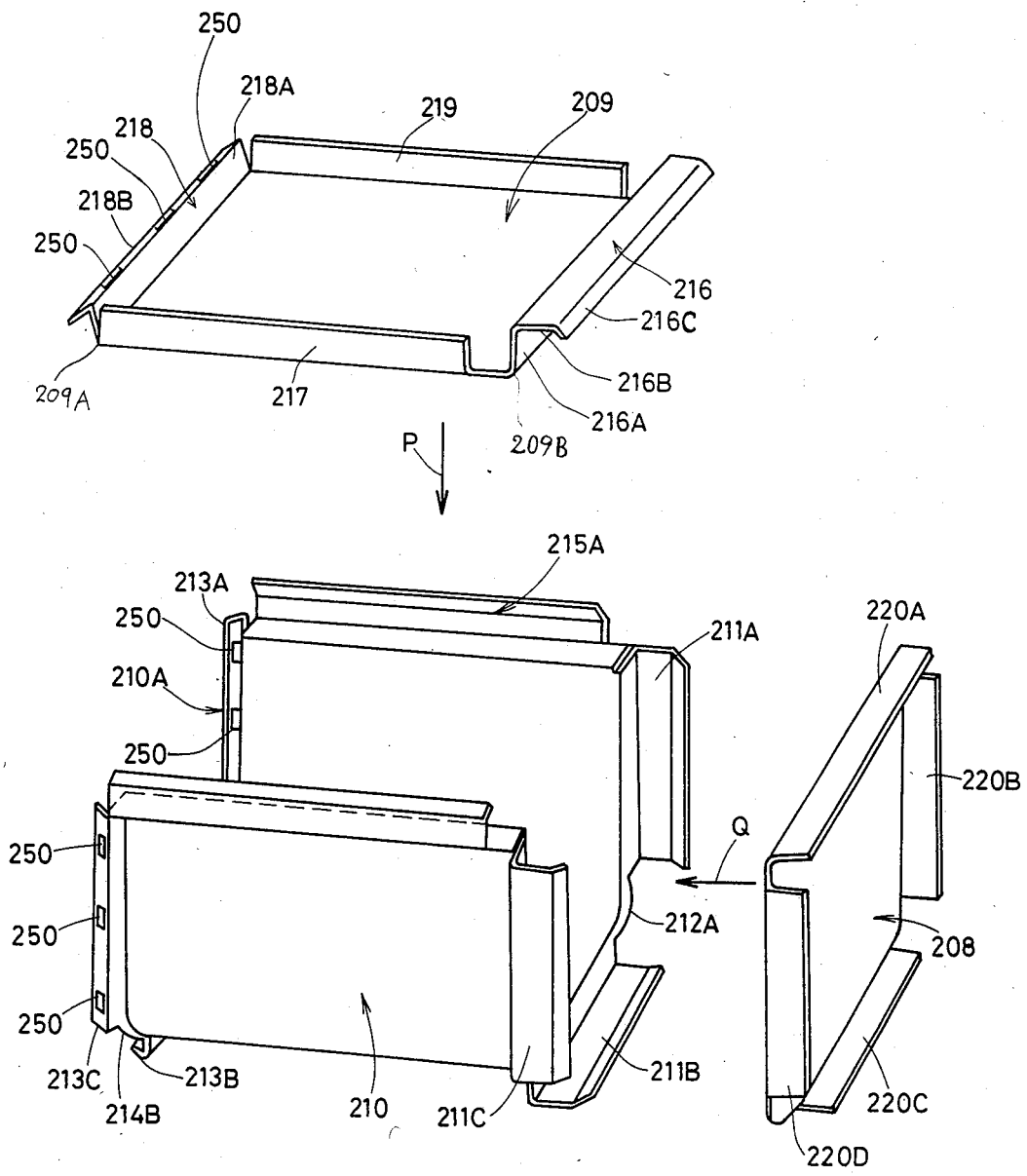
FIG. 16 is a perspective view showing a joining operation on a third embodiment of this invention, similar to FIG. 4 in the first embodiment.

FIG. 16 is a perspective view for explaining a third embodiment of this invention, corresponding to FIG. 4 in the first embodiment. The feature of the third embodiment resides in the constructions of the joints between a front panel and a barrel panel 210 and between the front panel and a top panel 209. The rest of the structure is the same as in the first embodiment, and a description thereof is omitted. As is clear from FIG. 16, the front end edge of the barrel panel 210 is formed with curling allowances 213A, 213B and 213C. Each of the curling allowances 213A, 213B and 213C is formed with three slits 250. The curling allowance 218 on the front end edge of the top panel 209 is also formed with three slits 250. On the other hand, as is clear from FIG. 17, the peripheral edge 207A of the opening 207 in the front panel 205 is formed with 9 locking elements 251 corresponding to said slits 250. In addition, since the construction of the joint between the front panel 205 the top panel 209 is the same as the construction of the joint between the front panel 205 and the barrel panel 210, the construction of the joint between the front and barrel panels 205 and 210 will be described by way of example.

Figure 17:
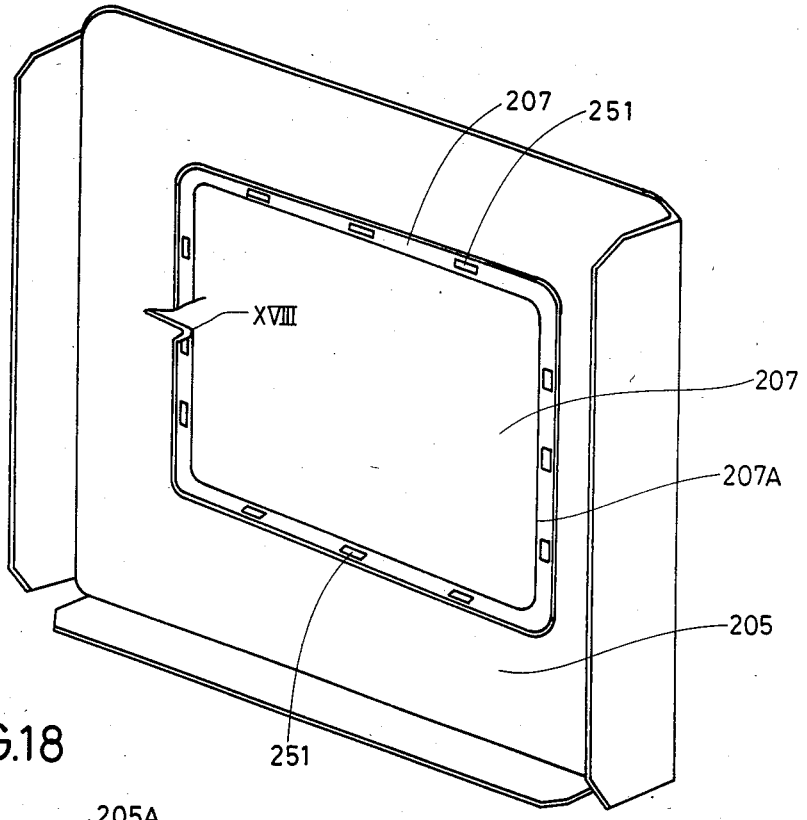
FIG. 17 is a perspective view looking at the back of a front panel used in the third embodiment.
Figure 18:
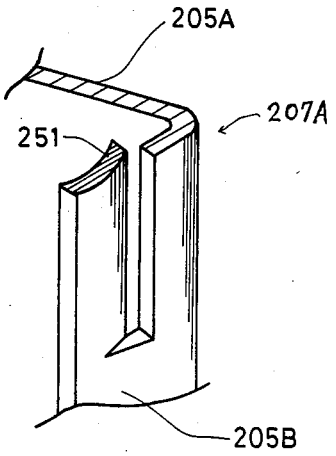
FIG. 18 is a fragmentary perspective view showing, on an enlarged scale, a portion XVIII in FIG. 17.

FIG. 18 is a fragmentary perspective view showing, on an enlarged scale, a portion XVIII in FIG. 17. As is clear from FIG. 18, the peripheral edge 207A of the opening 207 in the front panel 205 is provided with a bent portion 205B formed by backwardly bending the main surface 205A of the front panel 205. A section of the bent portion 205B is formed as a locking element 251 by a cutting operation, with its front edge directed to the inside, i.e., to the main surface 205A.

Figure 19:
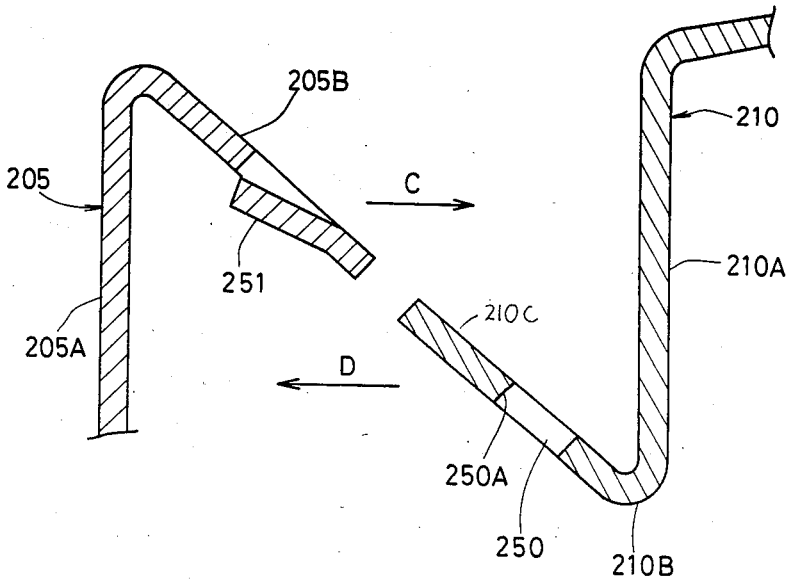
FIG. 19 is a fragmentary sectional view showing an operation for joining the front and barrel panels in the third embodiment of this invention.
Figure 20:
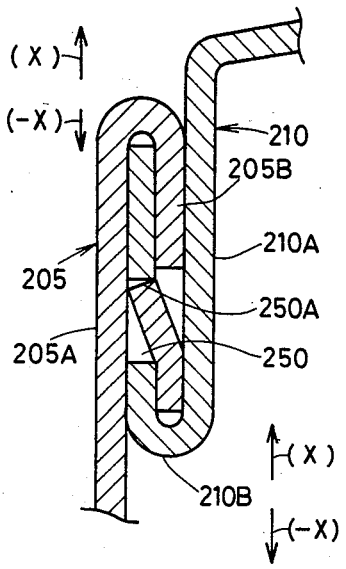
FIG. 20 is a fragmentary sectional view showing the construction resulting from the joining operation shown in FIG. 19.

FIG. 19 is a fragmentary sectional view showing an operation for joining the front and barrel panels 205 and 210 of the aforesaid construction. FIG. 20 is a fragmentary sectional view showing the construction of the joint resulting from the joining operation shown in FIG. 19. As is clear from FIG. 19, the front end edge of the barrel panel 210 is provided with a bent portion 210C bent forwardly of the end edge 210B of the first wing portion 210A. A portion of the bent portion 210C is provided with a slit 250. The configuration of the slit 250 is such as to receive the locking element 251 provided on the bent portion 205B of said front panel 205. When the front and barrel panels 205 and 210 processed in the manner described above are superposed in the directions of arrows C and D in FIG. 19 and curled, joint construction shown in FIG. 20 results. As is clear from FIG. 20, the front end of the locking element 251 provided on the bent portion 205B of the front panel 205 is opposed to and in contact with one end surface 250A of the slit 250 of the barrel panel 210. Therefore, in the joint construction shown in FIG. 20, even if the front and barrel panels 205 and 210 are pulled or pushed in the direction of arrow X or −X in FIG. 20, there is no danger of the joint being dislocated. For this reason, the construction of the joint between the front and barrel panels 205 and 210 in the third embodiment of this invention shown in FIG. 20 has a much higher joining strength than that of the conventional curled joint construction.

Figure 21:
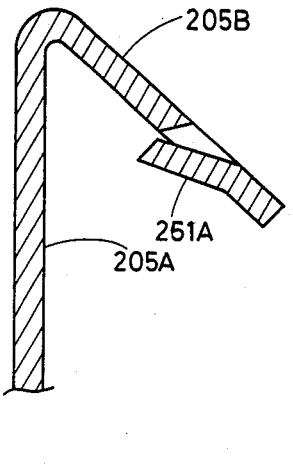
FIG. 21 is a fragmentary sectional view showing another example of the joint portion of the front panel shown in FIG. 19.
Figure 22:
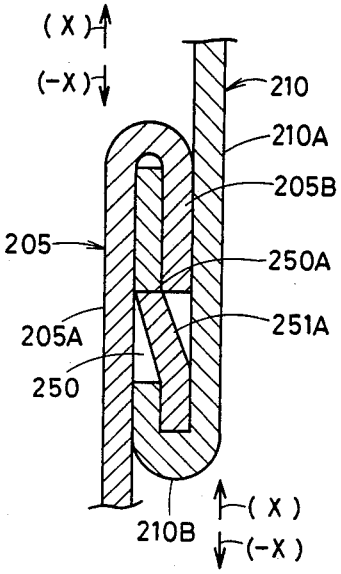
FIG. 22 is a fragmentary sectional view showing the construction of a joint between the front and barrel panels where the front panel has a curling or crimping allowance in the form shown in FIG. 19.

In the joint construction shown in FIGS. 19 and 20, the front end of the locking element 251 formed on the bent portion 205B of the front panel 205 has been formed by cutting into the bent portion 205B perpendicularly to the main surface, but as shown in FIG. 21 a locking element 251A may be formed by obliquely cutting into a section of the bent portion 205B. In this case, as is clear from FIG. 22, the front end surface of the locking element 251A is contacted with one end surface 250A throughout. Therefore, the construction of the joint shown in FIG. 22 remains firmly locked even if the front and barrel panels 205 and 210 are pulled or pushed in the direction of arrow X or −X.

Figure 23:
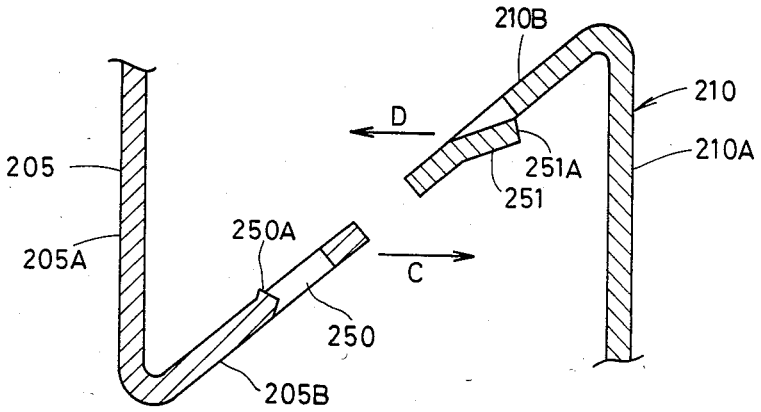
FIG. 23 is a fragmentary sectional view corresponding to FIG. 19, showing an operation for joining the front and barrel panels, where another form of curling or crimping allowance is used.
Figure 24:
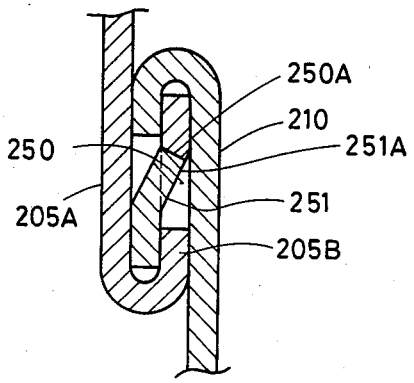
FIG. 24 is a fragmentary sectional view showing the construction of a joint resulting from the joining operation shown in FIG. 23.

FIGS. 23 and 24 show a further modification of the joint construction of FIG. 20. FIG. 23 shows a joining operation with the aid of locking means in the form of a slit 250 in the front panel 205, while the barrel panel 210 is formed with a locking lug 251. Further, one end surface 250A of the slit 250 is formed by being cut out of the bent portion 205B of the front panel 205 and somewhat raised toward the main surface 205A. Therefore, as is clear from FIG. 24, the front and barrel panels 205 and 210 are firmly joined and locked together, with one end surface 250A of the slit 250 closely contacted by the front end surface 251A of the locking element 251.

Figure 25:
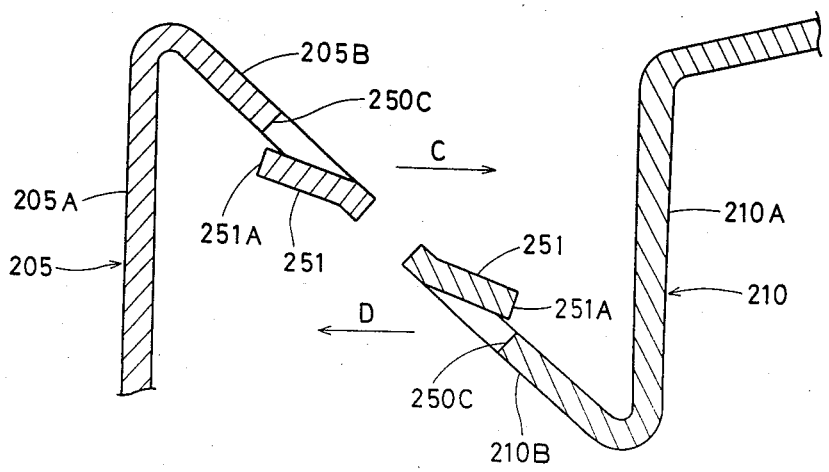
FIG. 25 is a fragmentary sectional view showing an operation for joining the front and barrel panels, where a different form of curling or crimping allowance for the front and barrel panels from that shown in FIG. 19 is used.
Figure 26:
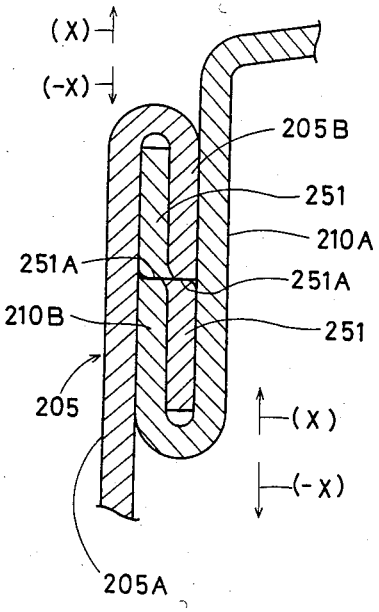
FIG. 26 is a fragmentary sectional view showing the construction of the joint resulting from the joining operation shown in FIG. 25.

FIGS. 25 and 26 are views for explaining a different example of the locking means between the front and barrel panels 205 and 210. According to FIG. 25, each of the front and barrel panels 205 and 210 is formed with a locking element 251 by a cutting operation. The space left behind by the locking lug 251 performs a function corresponding to that of the slit 250 shown in FIGS. 19 and 20. That is, the cut surface 250C of the portion from which the front end surface 251A of each locking element 251 has been removed performs the same function as that of one end surface 250A of the slit 250 shown in FIGS. 19 and 20. In FIG. 25, when the front and barrel panels 205 and 210 are superposed in the directions of arrows C and D and curled, the joint construction shown in FIG. 26 is obtained. At this time, the front end surfaces 251A of the locking elements 251 are turned back toward the main surface, i.e., into the bent portions 205B and 210C. However, since the locking elements 251 are cut out of the metal, they are not completely turned back. As a result, the front end surfaces 251A of the locking elements 251 project beyond the bent portions 205B and 210B toward the main surfaces 205A and 210A, respectively. The projecting portions of the locking elements are opposed to and contact each other. Therefore, as in the joint constructions shown in FIGS. 20, 22 and 24, even if the front and barrel panels 205 and 210 are pushed or pulled in the direction of arrows X and −X, the joint is kept strong.

Figure 28:
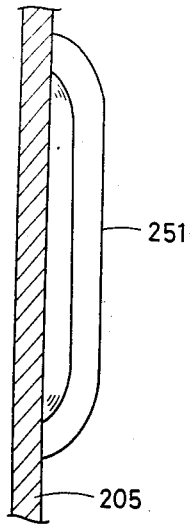
FIG. 28 is a fragmentary sectional view taken in the direction of arrow Y in FIG. 27, showing the planar configuration of the locking element shown in FIG. 27.
Figure 27:
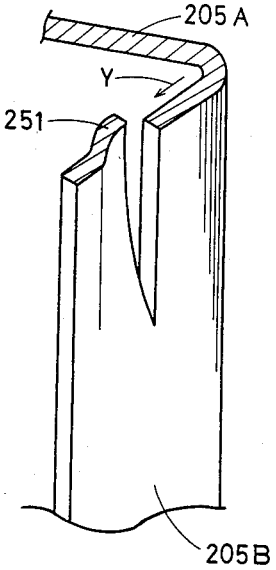
FIG. 27 is a fragmentary perspective view corresponding to FIG. 18, showing another example of a locking element for the front panel shown in FIG. 17.

In addition, it is not absolutely necessary that the front end surface of the locking elements 251 be separated from the bent portion 205B of the front panel 205 or from the bent portion 210C of the barrel panel 210. For example, as shown by a fragmentary sectional view in FIG. 27 and by a front view in FIG. 28 taken in the direction of arrow Y in FIG. 27, only the central portion of the locking elements 251 need to be pushed out of the surface of the bent portion 205B, with the opposite ends connected to the bent portion 205B.

Further, though not shown, the locking element and slit need not be formed throughout the respective bent portions of the front and barrel panels 205 and 210.

Figure 29:
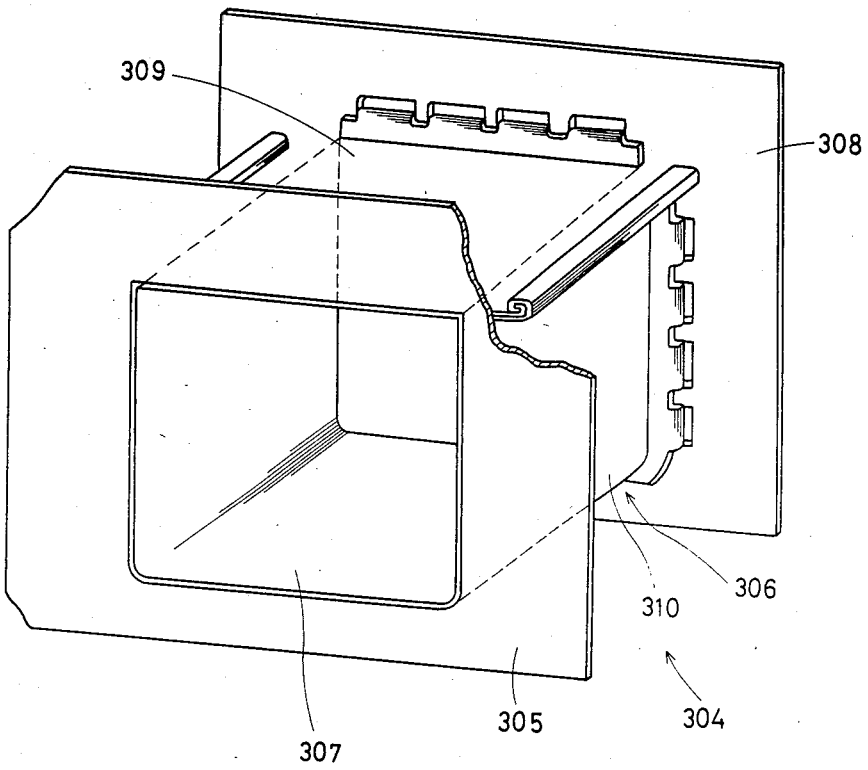
FIG. 29 is a fragmentary perspective view of a fourth embodiment of this invention.

FIG. 29 is a perspective view showing a fourth embodiment of this invention of an inner box of a microwave oven wherein each joint is formed by curling. That is, the joints between the front and barrel panels 305 and 310, between the front and top panels 305 and 309, between the barrel and rear panels 310 and 308, and between the top and rear panels 309 and 308 are all formed by curling. The feature of this embodiment resides in the construction of the joints between the barrel section 306 composed of the barrel and top panels 310 and 309, and the rear panel 308. The rest of the structure is the same as in the first embodiment and a description thereof is omitted.

Figure 30:
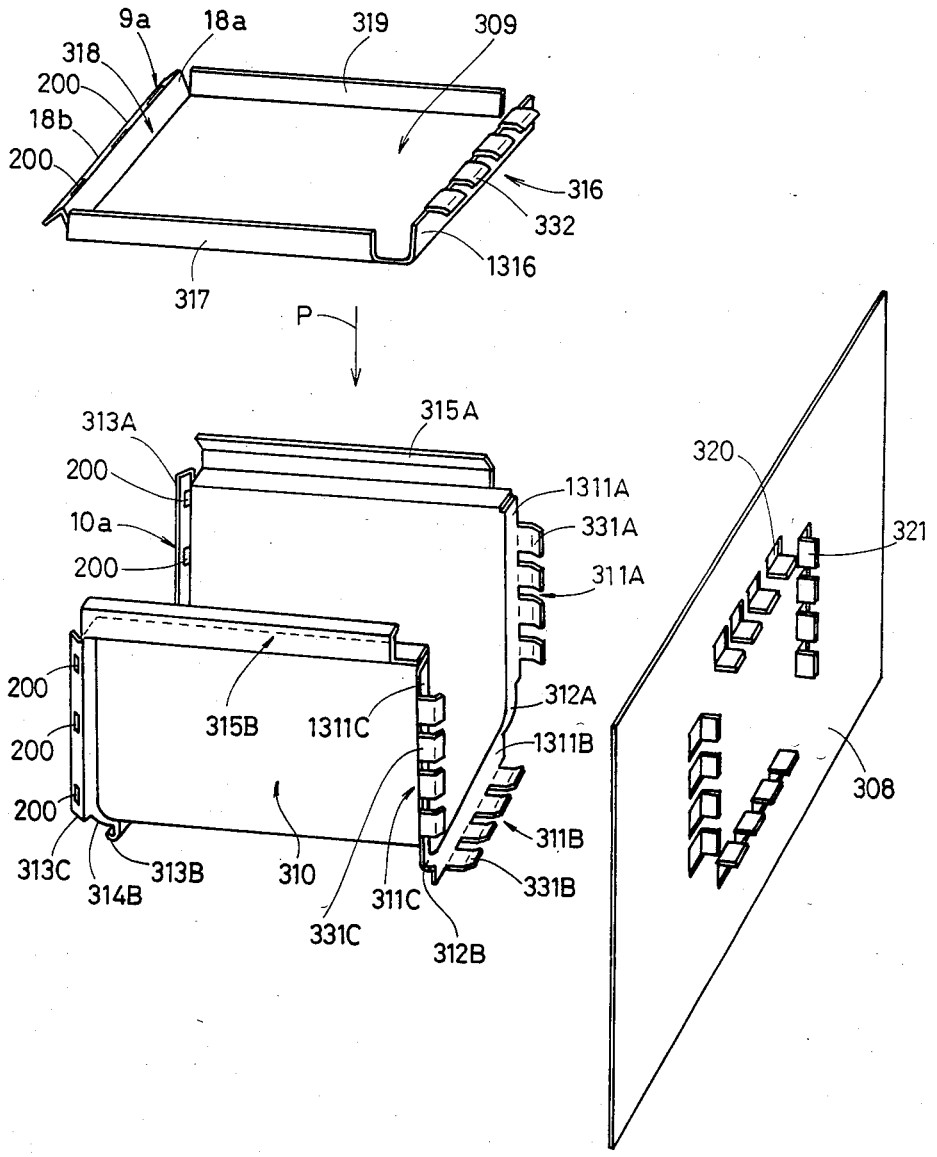
FIG. 30 is a perspective view showing a joining operation for the embodiment shown in FIG. 29.

FIG. 30 is a perspective view showing the first step of forming each joint shown in FIG. 29. The barrel panel 310 is fabricated of a sheet of metal, e.g., stainless steel and formed on one longitudinal side thereof with three curling allowances 311A, 311B and 311C and flange portions 312A and 312B and on the other longitudinal side thereof with three curling allowances 313A, 313B and 313C and flange portions 314B and on the other two sides thereof with curling allowances 315A and 315B, respectively, the sheet being then bent so that the longitudinal sides form a U-shape. The top panel 309 is formed on its outer peripheral edge with curling allowances 316, 317, 318 and 319. The rear panel 308 is formed with a plurality of openings 320 by a cutting operation, and cut portions of the rear panel 308 are extended in a direction opposite to the direction of the barrel and top panels 310 and 309 to be joined, so as to form second locking elements 321.

The top, barrel and rear panels 309, 310 and 308 formed with curling allowances as described above are joined together in the following manner: First, the top panel 309 is assembled to the barrel panel 310 in the direction of arrow P shown in FIG. 30. Next, the curling allowances 317 and 315B of the top and barrel panels 309 and 310 are joined together by curling and so are the curling allowances 319 and 315A of the top and barrel panels 309 and 310, whereby a barrel section is formed.

As is clear from FIG. 30, the rear end edge of the barrel panel 310 is formed with curling allowances 311A, 311B and 311C. The curling allowances 311A, 311B and 311C are formed with bent portions 1311A, 1311B and 1311C, respectively, outwardly bent substantially perpendicularly to the main surface of the barrel panel 310, the front ends of said bent portions being formed with a plurality of first locking elements 331A, 331B and 331C, respectively, extending toward the rear panel 308 to be joined. The front ends of the first locking elements 331A, 331B and 331C are bent slightly inwardly. Similarly, the curling allowance 316 on the rear end edge of the top panel 309 is formed with an outwardly bent portion 1316 extending substantially perpendicularly to the main surface of the top panel 309, the front end of said bent portion 1316 being formed with a plurality of first locking elements 332 extending toward the rear panel 309. The front ends of the first locking elements 332 are also bent slightly inwardly, i.e., upward as viewed in the figure.

Figure 31:
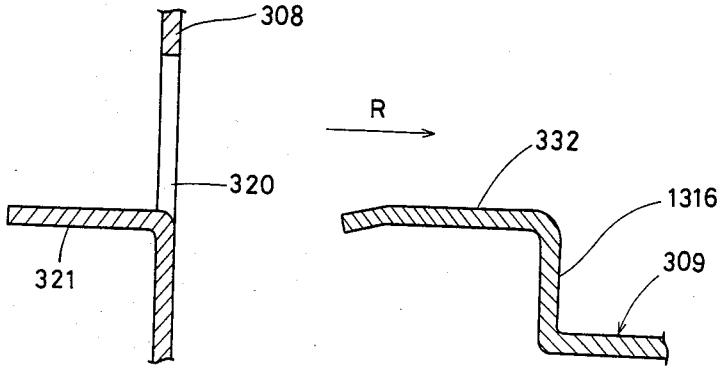
FIGS. 31 and 32 are fragmentary sectional views showing an operation for joining the top and rear panels in the embodiment shown in FIG. 30.
Figure 32:
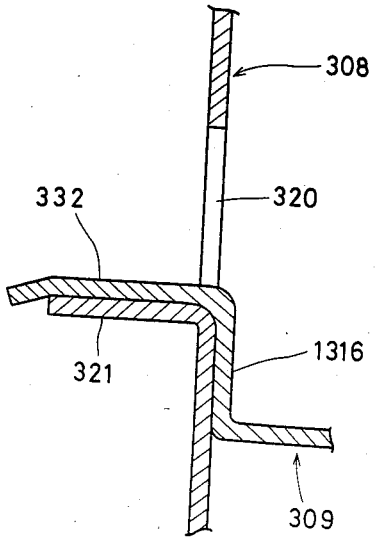

As described above, the rear panel 308 is formed with a plurality of openings 320 by cut-up operation for receiving the first locking elements 331A, 331B, 331C and 332 formed on the top panel 309 and the open end edge of the barrel panel 310. That is, when the rear panel 308 is abutted against the top and barrel panels 309 and 310, the first locking elements 331A, 331B, 331C and 332 are extended into the openings 320 and fitted to the second locking elements 321, please see the enlarged fragmentary sectional views in FIGS. 31 to 33. Referring to FIG. 31, the openings 320 in the rear panel 308 are brought nearer to the first locking elements 332 of the top panel 309 in the direction of arrow R. When the bent portion 1316 of the top panel 309 is contacted by the main surface of the rear panel 307, the first locking elements 332 underlie the second locking elements 321, as shown in FIG. 32. In this condition, a press die is abutted against the locking elements in the proper direction for performing a curling operation. The curled state is shown in a fragmentary sectional view in FIG. 33.

While the aforesaid joining operation has been described with reference to the joining of the top and rear panels 309 and 308, the description is also applicable to the joining of the barrel and rear panels 310 and 308.

Figure 34:
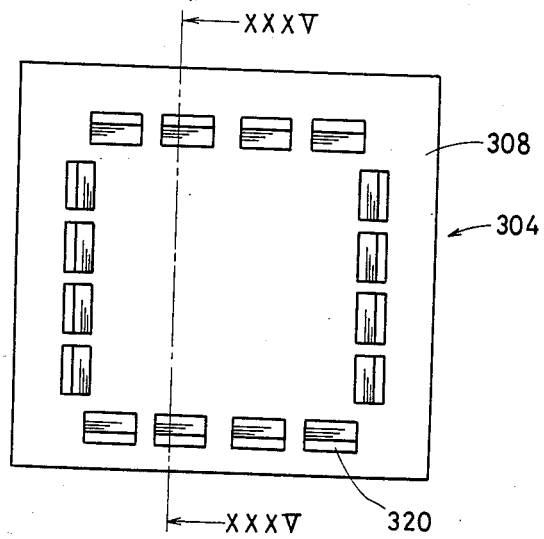
FIG. 34 is a view looking at the back of the rear panel joining to the top and barrel panels by the joining operation shown in FIGS. 31 to 33.
Figure 35:
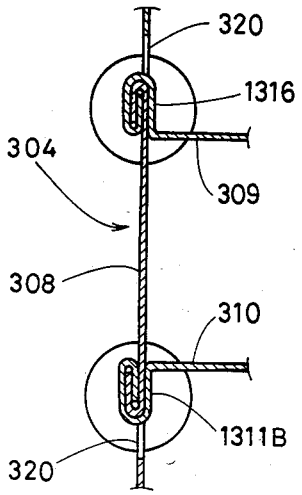
FIG. 35 is a fragmentary sectional view taken along a dash-dot line XXXV—XXXV in FIG. 34.

A rear view of the inner box 304 joined by said curling operation is shown in FIG. 34, wherein the barrel section 306 comprising the top and barrel panels 309 and 310, and the rear panel 308 are joined together at sixteen places. The relation between the barrel section 306 and the rear panel 308 thus joined together is shown in the fragmentary sectional view of FIG. 35 taken along the line XXXV—XXXV in FIG. 34. As is clear from FIG. 35, the curled joints are located outside the region where the top panel 309 and the main surface of the barrel panel 310 abut against the rear panel 308; thus, it will be understood that the interior of the inner box 304 is positively sealed. That is, the presence of the bent portions 316 and 1311B secures the sealed state of the inner box 304.

Figure 33:
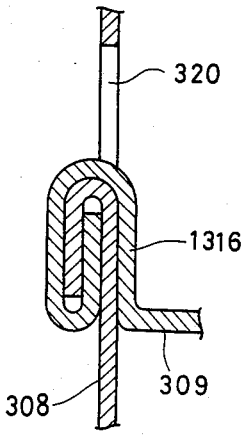
FIG. 33 is a fragmentary sectional view showing the construction of the joint resulting from the joining operation shown in FIGS. 31 and 32.
Figure 36:
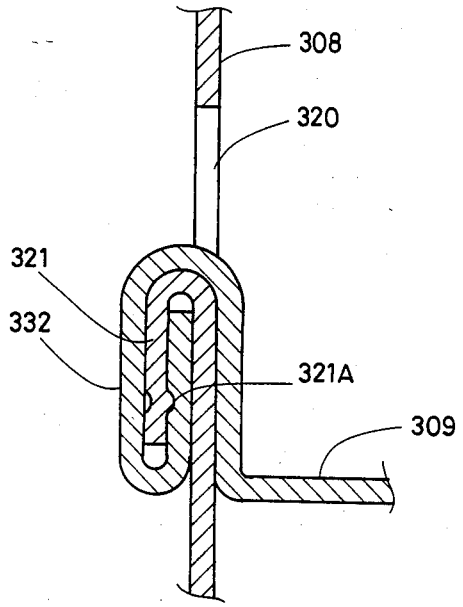
FIG. 36 is a fragmentary sectional view showing another example of the joint construction of the top and rear panels in the fourth embodiment of this invention.
Figure 37:
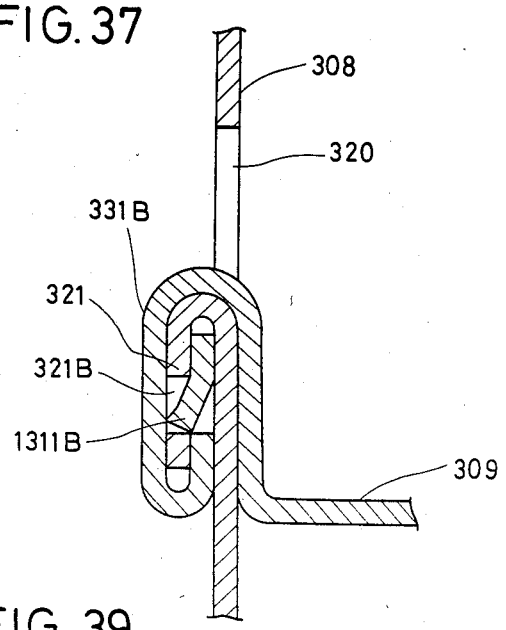
FIG. 37 is a fragmentary sectional view showing a further example of the joint construction of the top and rear panels in the fourth embodiment of this invention.

FIG. 36 is a fragmentary sectional view of another example of the joint construction shown in FIG. 33 wherein the front end of a second locking element 321 of the rear panel 308 is formed with a projection 321A, for example by punching. When a curling operation is performed, the projection 321A penetrates into the first locking element 332, thereby strengthening the joint construction provided by the curling operation as seen in FIG. 36. Similarly, as shown in FIG. 37, the front end of a second locking element 321 provided on the rear panel 308 may be formed with a slit 321B, while the front end of a first locking element 331B provided on the top panel 309 may be formed with a cut locking lug 3311B fitting into the slit 321B. Therefore, the joining strength perpendicular to the surface of the drawing sheet can be greatly increased.

Figure 38:
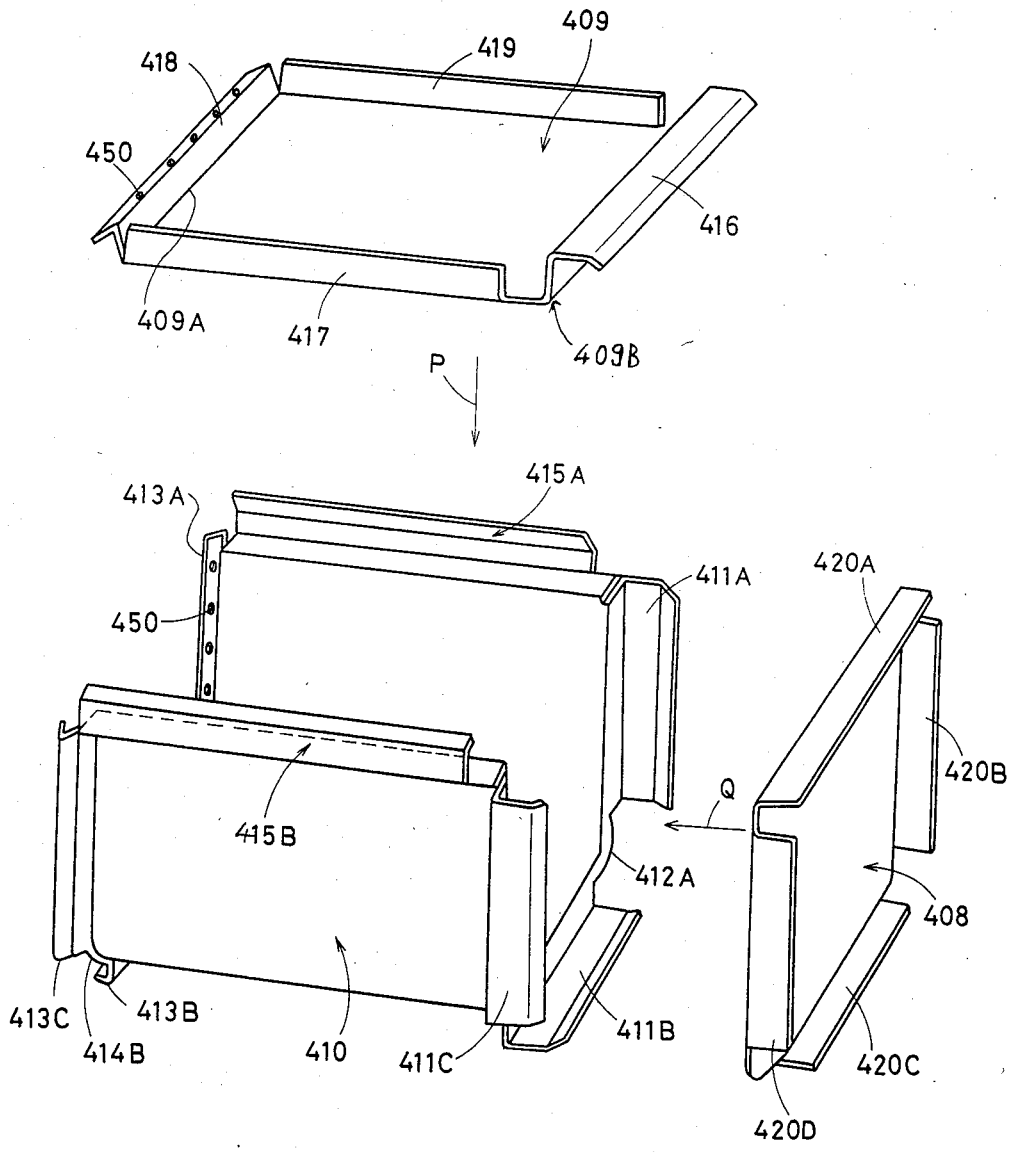
FIG. 38 is a perspective view showing a joining operation for a fifth embodiment of this invention.

FIG. 38 is a perspective view for explaining a fifth embodiment of this invention, similar to the first embodiment shown in FIG. 4. The feature of this embodiment resides in the constructions of the joints between the front panel 405, shown in FIG. 39, and the barrel panel 410 and between the front panel 405 and the top panel 409. The rest of the structure is the same as in the first embodiment and hence not described. Referring to FIG. 38, the front end edge of the barrel panel 410 is formed with curling allowances 413A, 413B and 413C in the form of bent portions. The curling allowances 413A, 413B and 413C are each formed with a plurality of holes 450. Further, the curling allowance 418 of the top panel 409 is also formed with a plurality of holes 450.

Figure 39:
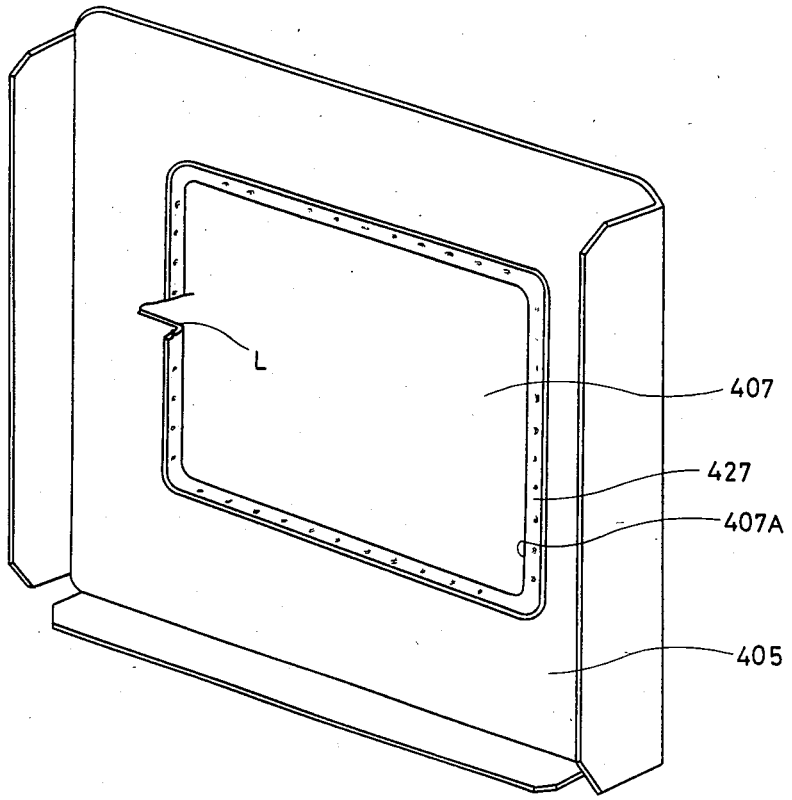
FIG. 39 is a perspective view looking at the back of the front panel used in the fifth embodiment of this invention.

On the other hand, as shown in FIG. 39, the peripheral edge 407A of the opening 407 in the front panel 405 is formed with projections 451 corresponding to said holes 450.

In addition, since the construction of the joint between the front and barrel panels 405 and 410 is the same as the construction of the joint between the front and top panels 405 and 409, only the construction of the joint between the front and top panels 405 and 409 will be described.

Figure 40:
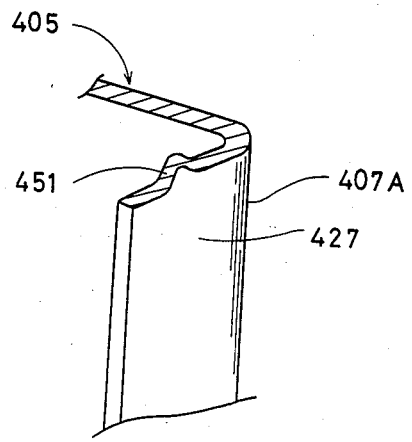
FIG. 40 is a fragmentary perspective view showing, on an enlarged scale, a portion L in FIG. 39.
Figure 41:
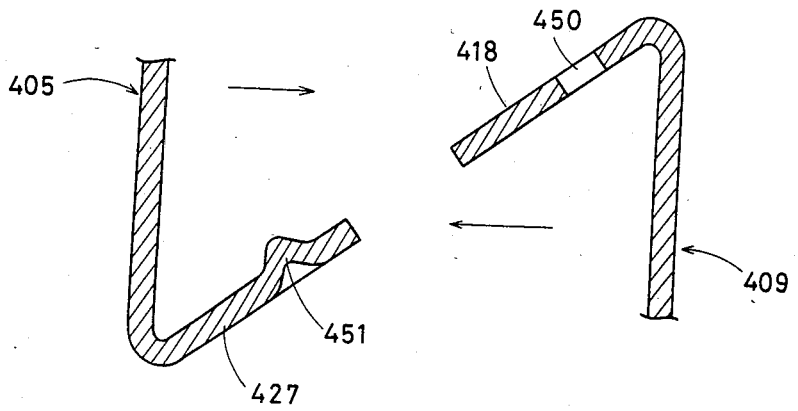
FIG. 41 is a fragmentary perspective view showing an operation for joining the top and front panels shown in FIGS. 38 and 39.

FIG. 40 is a fragmentary perspective view showing, on an enlarged scale, a portion L in FIG. 39 wherein the peripheral edge 407A of the opening 407 in the front panel 405 is formed with a bent portion 427 serving as a curling allowance. The bent portion 427 is formed with a locking projection 451 very easily formed as by a die before the processing of the front panel 405 shown in FIG. 39. The bent portion 427 of the top panel 405 having the locking projection 451, and the curling allowance 418 in the form of the bent portion of the top panel 409 are moved toward each other, as shown in FIG. 41, and put together, whereupon they are joined together by curling. In this case, the locking projection 451 is fitted in a hole 450 formed in the bent portion 418 of the top panel 409, thus providing a joint construction shown in a fragmentary sectional view in FIG. 42. Therefore, with the joint construction shown in FIG. 42, even if the front and top panels 405 and 409 are pulled or pushed in the directions of arrows X and −X, there is no danger of the joint being dislocated. Further, since the locking projection 451 has only to fit in the hole 450, there is no need to effect a complicated positioning of the front and top panels 405 and 409; thus, the locking projection 451 and hole 450 can be very easily fitted together.

Figure 42:
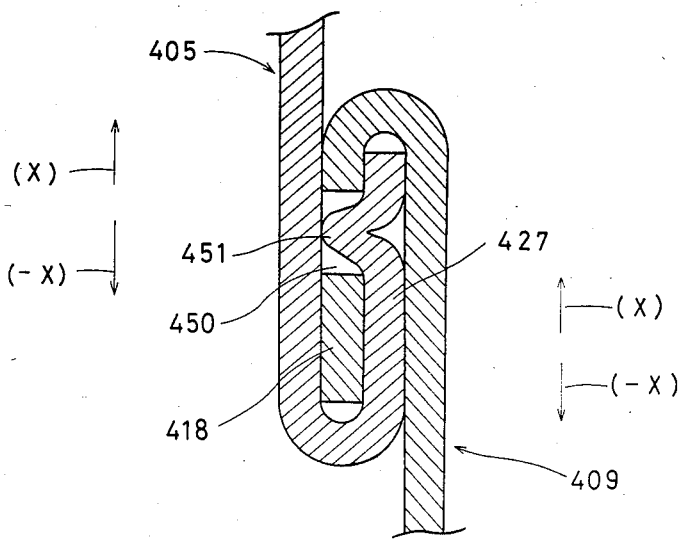
FIG. 42 is a fragmentary sectional view showing the construction of the joint resulting from the joining operation shown in FIG. 41.

In the construction shown in FIG. 42, the bent portion provided on the peripheral edge 407 of the opening in the front panel 405 has been provided with the locking projection 451, while the curling allowance 418 of the top panel 409 has been formed with a hole 450, but reversely, the front panel 405 may be formed with a hole for receiving the locking projection, in which case the curling allowance 418 of the top panel 409 will be provided with a locking projection 451.

Figure 42A:
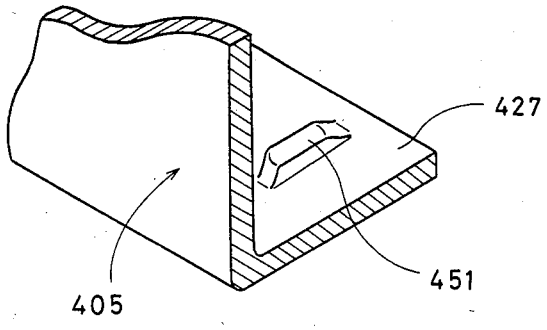
FIG. 42A is a fragmentary perspective view showing another example of a locking projection used in the joint construction shown in FIG. 42.

In addition, the locking projection 451 may be oval in plan view, as shown in FIG. 42A, which further facilitates the positioning of the locking projection 451 in the hole 451.

Figure 43:
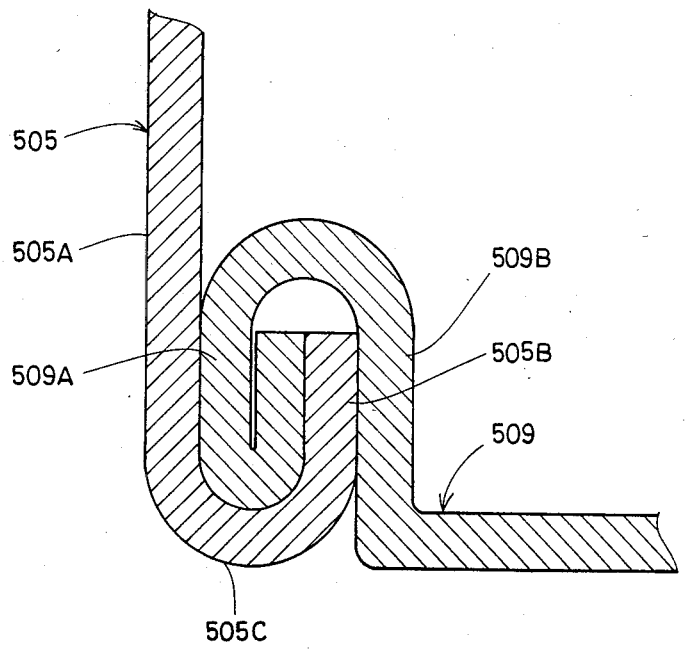
FIG. 43 is a fragmentary sectional view showing a modification of the joint construction resulting from the curling or crimping operation used in this invention.
Figure 44:
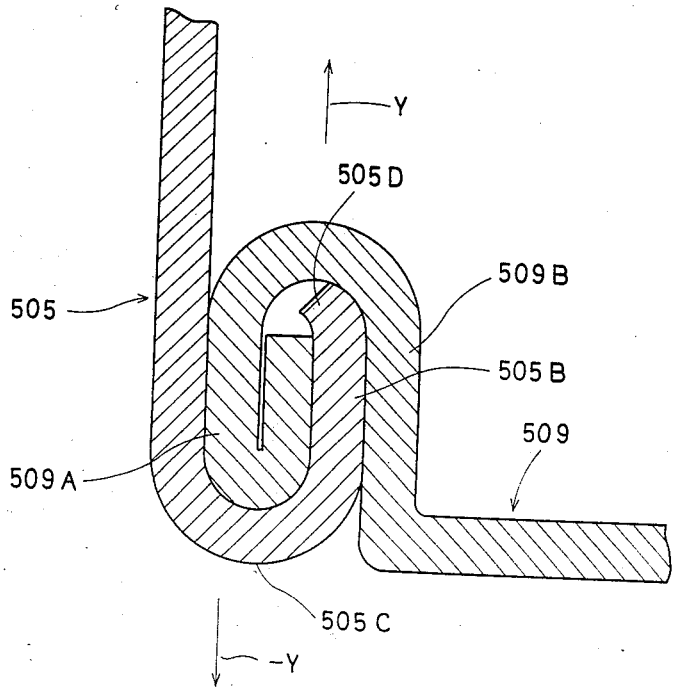
FIG. 44 is a fragmentary sectional view showing a further modification of the joint construction resulting from the curling operation used in this invention.

As has been described so far, various constructions for curled joints may be contemplated, but this invention is not limited to the embodiments described above. For example, FIG. 43 is a fragmentary sectional view of another example of the joint between the front and top panels, corresponding to FIG. 15. In this example, the front end 509A of the top panel 509 is turned back twice between the main surface 505A of the front panel 505 and the bent portion 505B of the front panel 505. Therefore, the curvature of the curved portion 505C between the main surface 505A of the front panel 505 and the bent portion 505B is far gentler than those of the curved portions in the joint constructions in the embodiments described so far. Where a painted steel sheet is used, the gentler curvature of the curved portion 505C in the joined portion of the front panel makes it possible to effectively prevent the peeling of the paint on the curved portion 505C. Further, the front end 509A of the top panel 509 is turned back twice and produces an expanding force, providing the merit that the bent portion 505C of the front panel 505 is more firmly fixed between the main surface 509B of the top panel 509 and the front end 510A. In FIG. 43, the front end 509A of the top panel 509 has been turned back twice, but it may be turned back three or four times. Further, the configuration of the turned-back portion is not limited to the one shown in FIG. 43. For example, as shown in FIG. 44, if the front end of the bent portion 505B is further bent to provide a locking portion 505D, it is possible to effectively prevent dislocation in the directions of arrows Y and −Y in FIG. 44.

Figure 45:
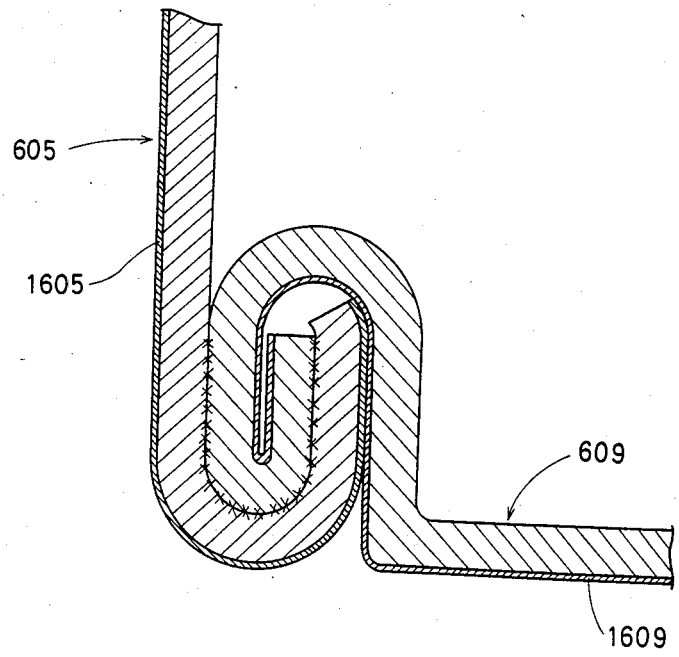
FIG. 45 is a fragmentary sectional view showing an example of the joint construction resulting from the curling operation capable of effectively preventing leakage of electric waves, the view showing the construction of the joint between the front and top panels.

FIG. 45 is a fragmentary sectional view showing, on an enlarged scale, the paint layer in the joint construction shown in FIG. 43. As described above, in the inner box for cooking appliances according to this invention, since the joints are formed by curling, it is possible to use a painted steel sheet to fabricate the inner box for cooking appliances. In this connection, painted steel sheets are usually formed with a paint layer only on one side. Therefore, in forming the inner box for cooking appliances, the painted steel sheet is fabricated so that the painted surface is on the external visible side of the inner box. In FIG. 45, the paint layer 1605 is positioned on the front surface of the front panel 605 and the paint layer 1609 is positioned on the inner surface of the top panel 609, i.e., on the side where food to be cooked is received. As is clear from FIG. 45, in this joint, since the front end portion of the top panel 609 is turned back twice, that region of contact between the front and top panels 605 and 609 which is formed with no paint layer, as marked with X is greater than half the total area of contact between the front and top panels 605 and 609. Thus, it follows that the area of electrically conductive portions is greater than half the total area of contact in the joint. I have conducted extensive experiments and found that in the case where the area of electrically conductive portions is less than $\frac{1}{3}$ of the total area of contact between the front and top panels 605 and 609, there is a problem that the paint layers 1605 and 1609 becomes heated whereby the paint is burned, causing leakage of electric waves. According to the joint shown in FIG. 45, since the area of the electrically conductive portion is greater than $\frac{1}{2}$, such leakage of electric waves can be effectively prevented.

Figure 46:
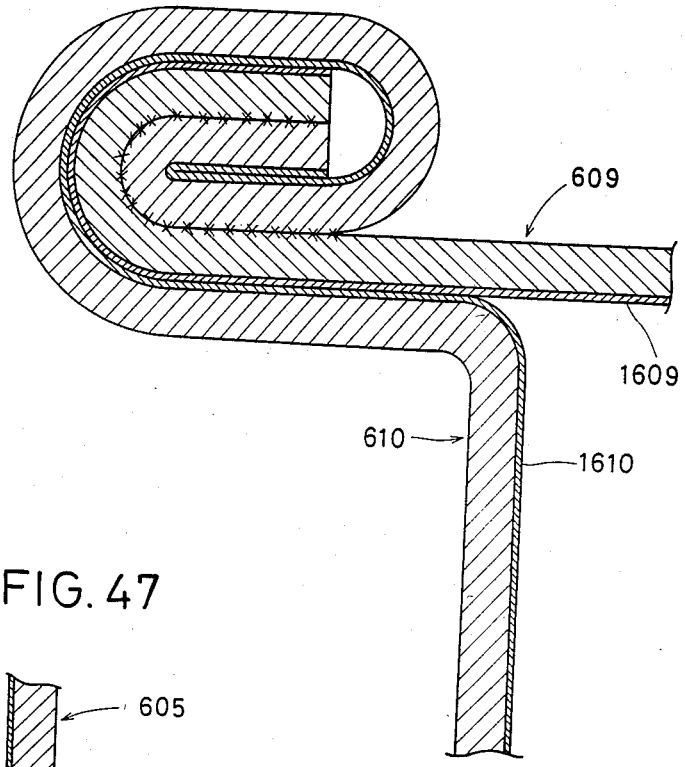
FIG. 46 is a fragmentary sectional view showing another example of the construction of the joint between the barrel and top panels.
Figure 47:
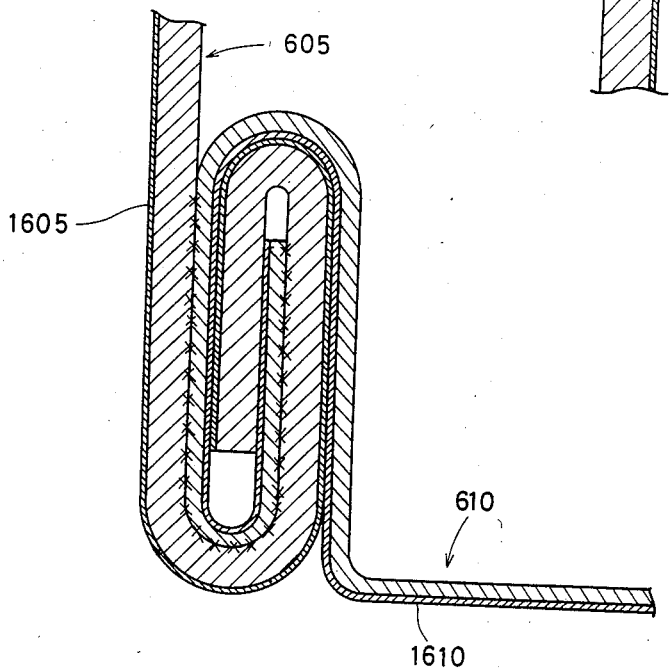
FIG. 47 is a fragmentary sectional view showing another example of the joint between the top and front panels.

Thus, it has been found that leakage of electric waves due to the burning of paint layers when painted steel sheets are used can be prevented by making the area of contact of electrically conductive portions in the joint greater than $\frac{1}{2}$ of the total area of contact. The joint construction that meets this condition is not limited to the one shown in FIG. 45. For example, the construction of the joint between the top and barrel panels 609 and 610 may be in the form shown in FIG. 46, wherein the area of contact of electrically conductive portions in the joint is also greater than $\frac{1}{2}$ of the total area of contact. Further, as shown in a fragmentary sectional view in FIG. 47, it is possible to make the area of contact of electrically conductive portions, i.e., unpainted portions greater than $\frac{1}{2}$ of the total area of contact by turning back twice the bent portions of both the barrel panel 610 and the front panel 605.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An inner box of sheet metal, especially for a cooking appliance comprising a front panel, a rear panel, and a barrel section, an opening in said barrel section, said front panel having an inner peripheral sheet metal edge around said opening, said rear panel having an outer peripheral sheet metal edge, said barrel section having a front end sheet metal edge and a rear end sheet metal edge, first crimped joint means operatively engaging said barrel front end sheet metal edge with said inner peripheral sheet metal edge around said opening of said front panel for joining said barrel section to said front panel, second crimped joint means operatively engaging said barrel rear end sheet metal edge with said outer peripheral sheet metal edge of said rear panel for joining said barrel section to said rear panel, at least one of said first and second crimped joint means comprising first locking means in the sheet metal forming one sheet metal edge of said sheet metal edges participating in the formation of said at least one crimped joint means, and second locking means in the sheet metal forming the other sheet metal edge of said sheet metal edges also participating in the formation of said one crimped joint means, said first and second locking means being so positioned that said first and second locking means engage each other as a result of a crimping operation for interlocking the respective crimped joint means, said first and second locking means in their locked state opposing forces tending to open the respective crimped joint means, and wherein said first locking means comprises a projecting locking element extending out of said one sheet metal edge, and wherein said second locking means comprise a slit in the respective other sheet metal edge for locking receiving said projecting locking element in the locked state of the first and second locking means as a result of a crimping operation.

2. The box of claim 1, wherein said first crimped joint means joining said barrel section to said front panel comprises a first crimping allowance froming said inner peripheral sheet metal edge around said opening and a second crimping allowance forming said front end sheet metal edge of said barrel section, said first crimping allowance comprising a first bent portion bent substantially perpendicularly out of said front panel toward said barrel section, and a second bent portion extending fromm the front end of said first bent portion in a direction widening said opening, said second crimping allowance comprising a third bent portion bent outwardly substantially perpendicularly out of said barrel section, a fourth bent portion extending from a front end of said third bent portion toward said front panel, and a fifth bent portion extending from a front end of said fourth bent portion in a direction narrowing said opening.

3. The box of claim 1, wherein said first locking means comprise a plurality of first locking elements extending out of said one sheet metal edge, and wherein said second locking means comprise a respective plurality of openings in said other sheet metal edge and a corresponding plurality of lugs adjacent to said openings, said first locking elements extending through said openings for an interlocking engagement with a respective one of said lugs as a result of a crimping operation.

4. The box of claim 1, wherein the sheet metal edges in at least one of said first and second crimped joint means comprise a shape formed by curling back these sheet metal edges at least twice.

5. The box of claim 1, wherein said sheet metal is painted steel, and wherein an unpainted portion of a contact area in said crimped joint means is greater than about 50% of a total contact area between two painted steel sheets in the respective crimped joint means.

6. An inner box of sheet metal, especially for a cooking appliance comprising a front panel, a rear panel, and a barrel section, an opening in said barrel section, said front panel having an inner peripheral sheet metal edge around said opening, said rear panel having an outer peripheral sheet metal edge, said barrel section having a front end sheet metal edge and a rear end sheet metal edge, first crimped joint means operatively engaging said barrel front end sheet metal edge within said inner peripheral sheet metal edge around said opening of said front panel for joining said barrel section to said front panel, second crimped joint means operatively engaging said barrel rear end sheet metal edge with said outer peripheral sheet metal edge of said rear panel for joining said barrel section to said rear panel, at least one of said first and second crimped joint means comprising first locking means in the sheet metal forming one sheet metal edge of said sheet metal edges participating in the formation of said at least one crimped joint means, and second locking means in the sheet metal forming the other sheet metal edge of said sheet metal edges also participating in the formation of said one crimped joint means, said first and second locking means being so positioned that said first and second locking means engage each other as a result of a crimping operation for interlocking the respective crimped joint means, said first and second locking means in their locked state opposing forces tending to open the respective crimped joint means, wherein said first locking means comprise locking projections arranged in a row, and wherein said second locking means comprise holes also arranged in a row for receiving each of said locking projections in a respective one of said holes as a result of a crimping operation.

* * * * *

UNITED STATES PATENT AND TRADEMARK OFFICE

CERTIFICATE OF CORRECTION

PATENT NO. : 4,563,559

DATED : January 7, 1986

INVENTOR(S) : Toshiaki Enami

It is certified that error appears in the above—identified patent and that said Letters Patent is hereby corrected as shown below:

Claim 1, column 15, line 13, replace "locking" by --lockingly--.

Claim 2, column 15, line 18, replace "froming" by --forming--;
column 15, line 25, replace "fromm" by --from--.

Claim 6, column 16, line 17, replace "within" by --with--.

Signed and Sealed this

*Twenty-fifth* Day of *March 1986*

[SEAL]

*Attest:*

DONALD J. QUIGG

*Attesting Officer*

*Commissioner of Patents and Trademarks*